US009294843B2

(12) United States Patent
Zhang

(10) Patent No.: US 9,294,843 B2
(45) Date of Patent: Mar. 22, 2016

(54) MULTIMEDIA ACOUSTICS SYSTEM HAVING AUDIO FREQUENCY DIGITAL INTERFACE

(76) Inventor: Fan Zhang, Futian Shenzhen (CN)

( * ) Notice: Subject to any disclaimer, the term of this patent is extended or adjusted under 35 U.S.C. 154(b) by 952 days.

(21) Appl. No.: 13/124,120

(22) PCT Filed: Oct. 13, 2008

(86) PCT No.: PCT/CN2008/072668

§ 371 (c)(1),
(2), (4) Date: Sep. 26, 2011

(87) PCT Pub. No.: WO2009/046682

PCT Pub. Date: Apr. 16, 2009

(65) Prior Publication Data

US 2012/0020479 A1 Jan. 26, 2012

(51) Int. Cl.

| | |
|---|---|
| ***H04R 5/02*** | (2006.01) |
| ***H04R 9/02*** | (2006.01) |
| ***H04R 9/04*** | (2006.01) |
| ***H04R 9/06*** | (2006.01) |
| *H04R 3/14* | (2006.01) |

(52) U.S. Cl.

CPC ..... *H04R 9/025* (2013.01); *H04R 9/046* (2013.01); *H04R 9/06* (2013.01); *H04R 3/14* (2013.01); *H04R 2209/041* (2013.01)

(58) Field of Classification Search

None

See application file for complete search history.

(56) References Cited

U.S. PATENT DOCUMENTS

| | | | | |
|---|---|---|---|---|
| 5,748,760 | A | 5/1998 | Button | |
| 5,849,760 | A | 12/1998 | Calvet | |
| 6,795,564 | B2 | 9/2004 | Zhang | |
| 2003/0218391 | A1 * | 11/2003 | Hirata | 310/12 |
| 2005/0058304 | A1 | 3/2005 | Baumgarte et al. | |

(Continued)

FOREIGN PATENT DOCUMENTS

| | | | |
|---|---|---|---|
| CN | 1121809 | A | 5/1996 |
| CN | 1219834 | A | 6/1999 |
| CN | 2333135 | Y | 8/1999 |

(Continued)

OTHER PUBLICATIONS

"Sound Card." Wikipedia. Dec. 30, 2006. Web. <http://en.wikipedia.org/wiki/Sound_card>.*

(Continued)

*Primary Examiner* — Joseph Saunders, Jr.
*Assistant Examiner* — James Mooney
(74) *Attorney, Agent, or Firm* — Blakely, Sokoloff, Taylor & Zafman LLP

(57) ABSTRACT

A multimedia acoustics system having the audio frequency digital interface, which includes at least a USB or IEEE1394 interface, a USB or IEEE1394 outlay sound card, a set of D type or T type audio frequency power amplifier and controlling circuit or MPU chip which match it, a PCB board and at least more than a pair of sound box. In every sound box configuring a full band loudspeaker and/or bandpass heavy undertone loudspeaker whose caliber is no more than 7 inches, the loudspeaker is configured a single diaphragm more magnet gaps and more loops which have resistance load characteristic or approximately resistance load characteristic, thereby form audio frequency digital multimedia acoustics system which has super high sensitivity and high fidelity quality and has 2.0 or 2.1 channel which is supplied by pc USB or IEEE1394 interface and 4.1~7.1 channel which is supplied by single power supply.

16 Claims, 14 Drawing Sheets

(56) References Cited

U.S. PATENT DOCUMENTS

| | | | | |
|---|---|---|---|---|
| 2005/0099255 | A1* | 5/2005 | Zhang | 335/251 |
| 2006/0029238 | A1 | 2/2006 | Kushida | |

FOREIGN PATENT DOCUMENTS

| | | | |
|---|---|---|---|
| CN | 1270488 | A | 10/2000 |
| CN | 1285706 | A | 2/2001 |
| CN | 2437092 | Y | 6/2001 |
| CN | 1347628 | A | 5/2002 |
| CN | 1121809 | C | 9/2003 |
| CN | 1567282 | A | 1/2005 |
| CN | 1661588 | A | 8/2005 |
| CN | 1735282 | A | 2/2006 |
| CN | 1741683 | A | 3/2006 |
| CN | 2822084 | Y | 9/2006 |
| CN | 101026901 | A | 8/2007 |
| CN | 200941682 | Y | 8/2007 |
| CN | 101409853 | A | 4/2009 |
| CN | 101415143 | A | 4/2009 |
| CN | 201274572 | Y | 7/2009 |
| CN | 101971645 | A | 2/2011 |
| DE | 102005036538 | A1 | 2/2006 |
| JP | H08331691 | A | 12/1996 |
| JP | H09322294 | A | 12/1997 |
| JP | H114500 | A | 1/1999 |
| JP | H11331984 | A | 11/1999 |
| JP | 2001148894 | A | 5/2001 |
| JP | 2003-531508 | A | 10/2003 |
| JP | 2003531508 | A | 10/2003 |
| JP | 2004139324 | A | 5/2004 |
| JP | 2005223372 | A | 8/2005 |
| JP | 2006050245 | A | 2/2006 |
| TW | 429718 | | 4/2001 |
| WO | WO 9633592 | A1 | 10/1996 |
| WO | WO 99/31931 | A1 | 6/1999 |
| WO | WO 01/15493 | A1 | 3/2001 |
| WO | WO2007103937 | * | 9/2007 |
| WO | WO 2009/046682 | A1 | 4/2009 |

OTHER PUBLICATIONS

"Digital Sound System 80." Wikipedia. <http://en.wikipedia.org/wiki/Sound_card>.*

Davis, Roy. "Tech Tip 44—Computer Interconnections III." Geeks.com. Sep. 15, 2005. <http://www.geeks.com/techtips/2005/techtips-SEP15-05.htm>.*

PCT International Search Report for PCT Counterpart Application No. PCT/CN2008/072668 containing Communication relating to the Results of the Partial International Search Report, 4 pgs., (Jan. 22, 2009).

International Preliminary Report on Patentability, Chapter I, PCT Application No. PCT/CN2008/072668; Apr. 13, 2010; 4pgs.

* cited by examiner

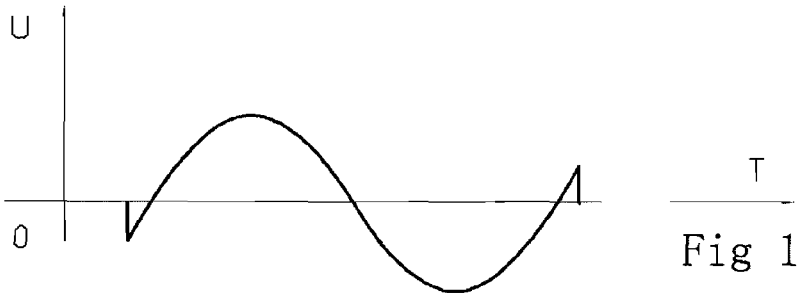
Fig 11-A
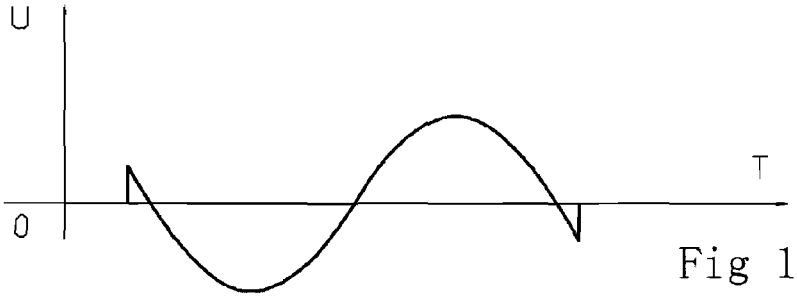
Fig 11-B
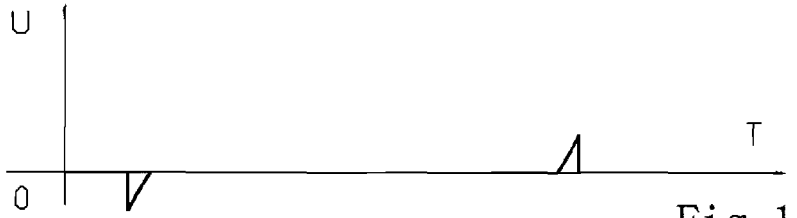
Fig 11-C
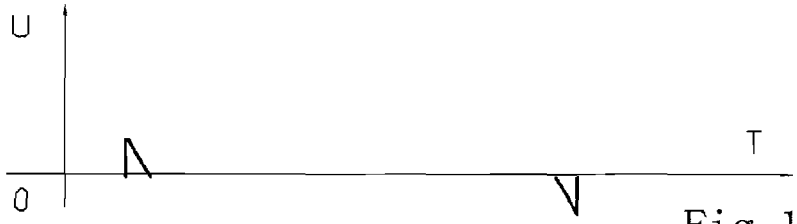
Fig 11-D

Fig 12
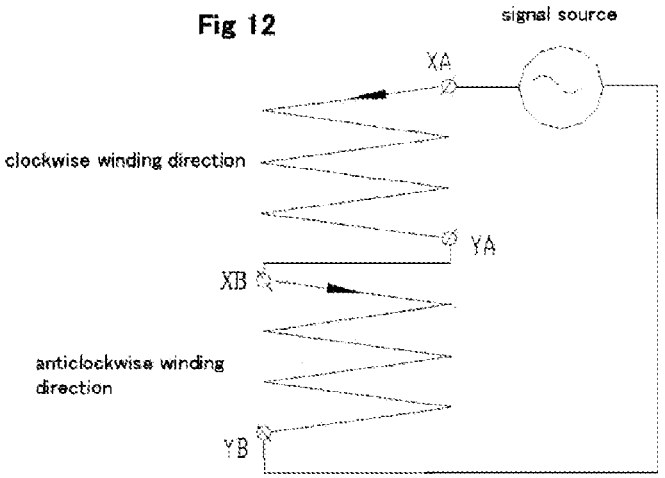
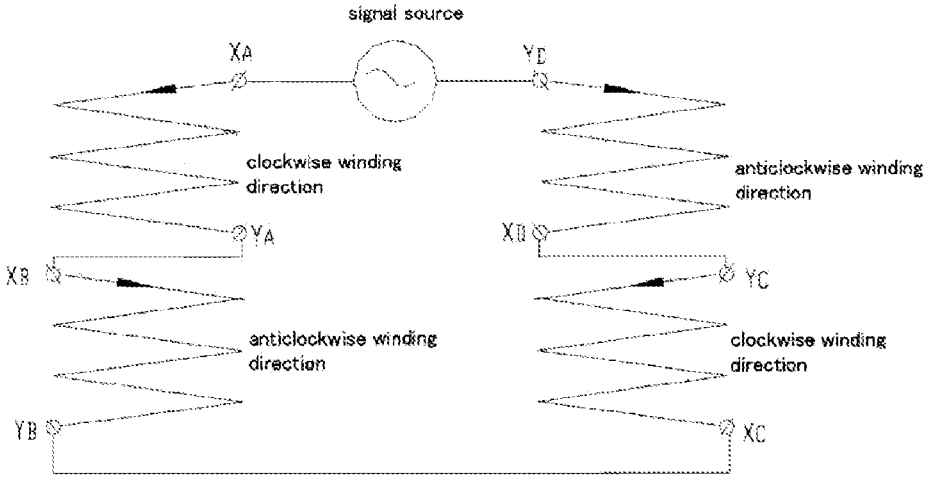
Fig 15

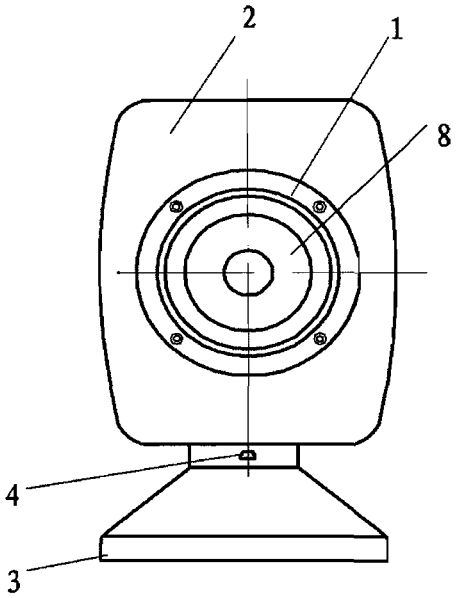
Fig 16-A
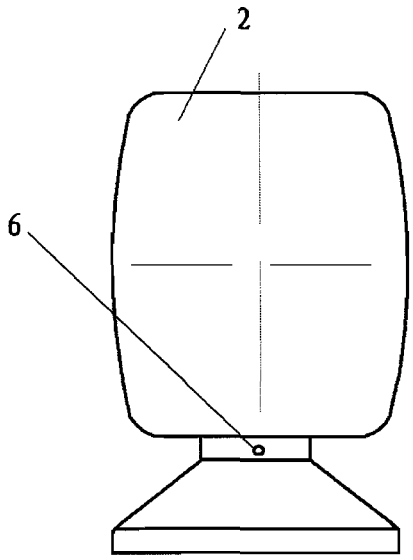
Fig 16-B
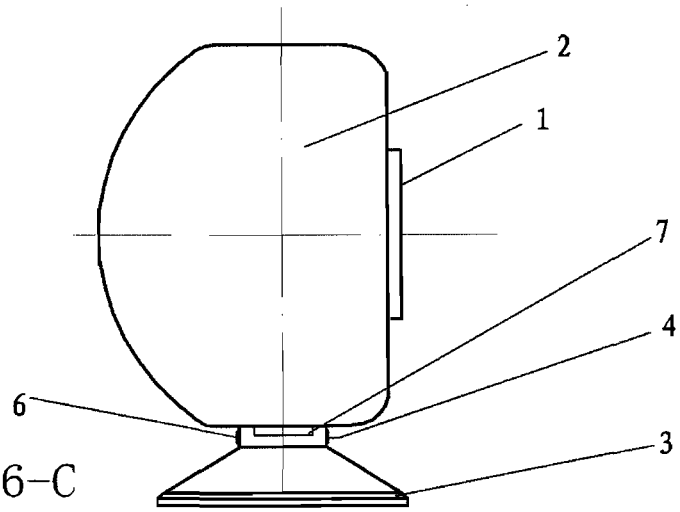
Fig 16-C

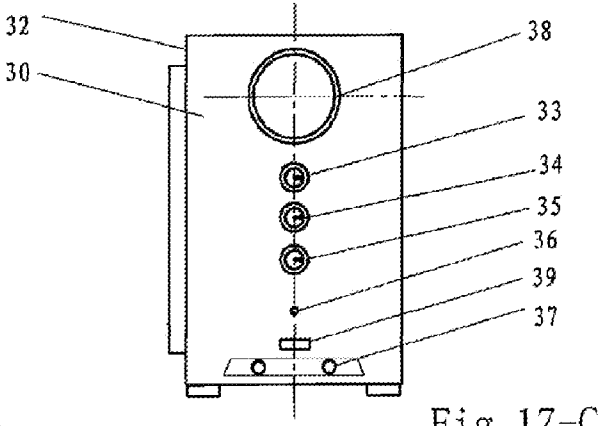
Fig 17-C
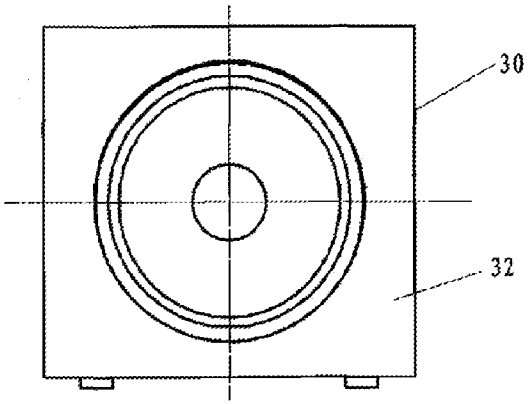
Fig 17-D
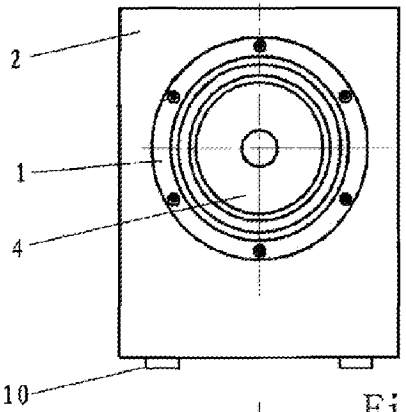
Fig 17-A
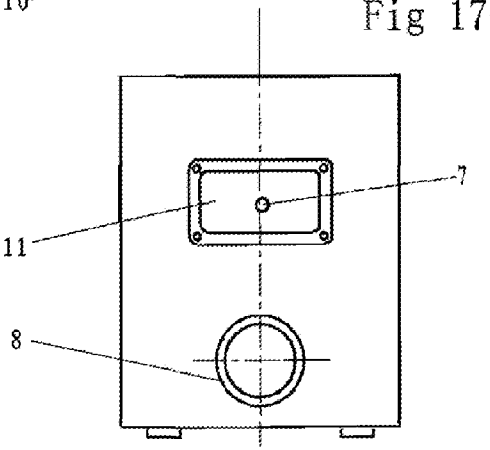
Fig 17-B

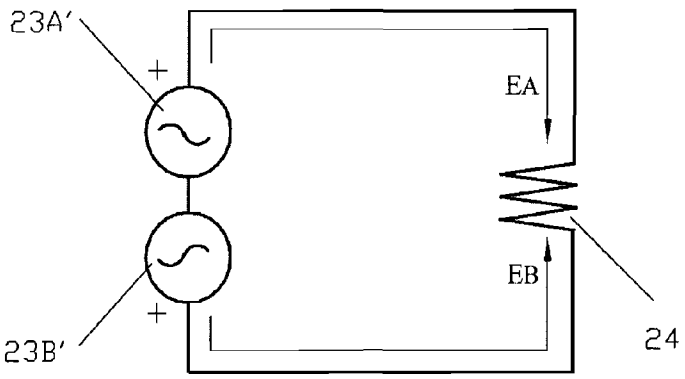
Fig 21
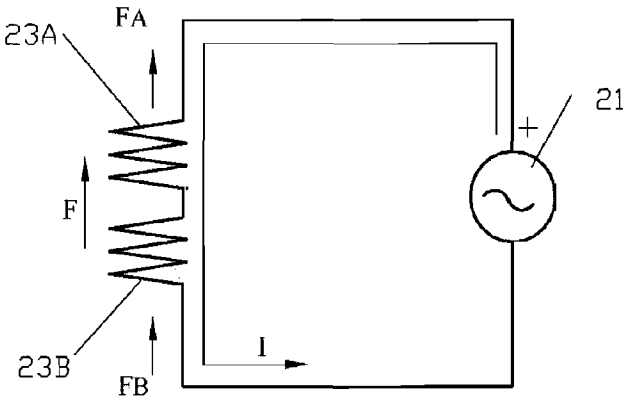
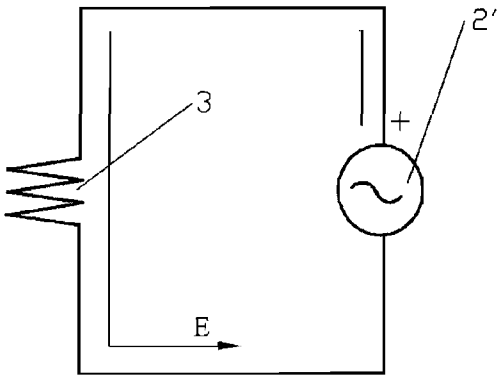
Fig 20
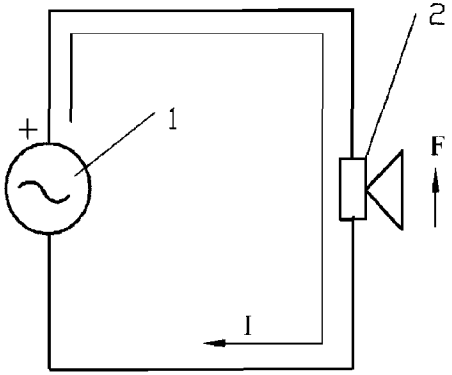

MULTIMEDIA ACOUSTICS SYSTEM HAVING AUDIO FREQUENCY DIGITAL INTERFACE

CROSS-REFERENCE TO RELATED APPLICATION

This patent application is a U.S. National Phase application under 35 U.S.C. §371 of International Application No. PCT/CN2008/072668, filed on Oct. 13, 2008, entitled MULTIMEDIA ACOUSTICS SYSTEM HAVING AUDIO FREQUENCY DIGITAL INTERFACE.

FIELD OF THE INVENTION

The present invention relates to a multimedia sound system with digital audio interface, especially relates to a digital multimedia sound system which is equipped with USB external sound card or IEEE1394 external sound card and powered by computer or CD-ROM game. And it pertains to the electronic acoustic field of the electrical science.

BACKGROUND OF THE INVENTION

Multimedia sound system with digital audio interface, comprising multimedia sound system equipped with USB external sound card or IEEE1394 external sound card is a prior art.

For instance, Microsoft launched a DSS 80 USB sound system powered by external power supply at the end of last century.

In 2006, PHILIPS released a DGX320 sound system with a 1-inch high pitch speaker, a 2-inch full frequency band speaker and a passive bass radiator built in each speaker. The sound system is powered by PC USB interface with an output power of 2×1 W and a frequency response range of 100 Hz to 20 KHz.

In March 2006, DN-MPS100 sound system introduced by the Japanese company, EVERGREEN, consists of two 3-inch caliber speakers, of which one is mounted on a USB interface on panel board, while one is mounted MP3 codec on the back side of the speaker and radio circuits inside the speaker. The audio frequency input power of the sound system is 2×7 W. The sound system adopts attached AC adaptor and is independently powered by the power network.

In January 2007, at the CES exhibition, YAMAHA released a NX-U10 USB sound system. Adopting two 1.5-inch mini speakers, the sound system store the energy provided by PC USB interface of a notebook in a set of capacitor plates through "charging capacitor amplifier" technology and SR-Bass bass sound enhancement technology so as to satisfy the explosive demand of power handling when low audio frequency is output intensely. The frequency response range of the sound system is 90 Hz to 20 KHz.

However, a large number of mini USB sound systems based on a USB digital audio codec (DAC), 2 to 4 mini speakers, and a set of digital or analog output amplifiers, had ever flooded both domestic and foreign markets. On the whole, these products can not satisfy consumers' demands due to their poor sound quality and small sound volume.

It is known that the output voltage of PC USB interface is DC 5 volts (±5%) and the output current is 500 mA, which means each USB interface can only provide rated continuous power of 2.5 W. However, the rated continuous input power of a 2-inch caliber speaker is 2 W to 4 W and the SPL value can be as high as 83 dB/1 W/1 m. The rated continuous input power of a 1.25-inch to 1.5-inch speaker is roughly 1 W to 3 W and the SPL value is normally 79 to 82 dB/1 W/1 m. The rated continuous input power of a 3-inch caliber speaker is approximately 5 W to 8 W and the SPL value can hardly exceed 85 dB/1 W/1 m. Although the 3-inch speaker has a lower resonance frequency $F_o$, its electronic acoustic recovery quality of low audio frequency band is much better than mini speaker with a diameter that is less than 2 inches. Nevertheless, audio manufacturers would rather choose 2-inch caliber or smaller speakers with relatively poor sound quality as the sound unit of USB sound. That is because approximate 2×1 W electric power output by power amplifier of computer's USB sound system can hardly drive a pair of 3-inch caliber speakers as well as ensure ample sound volume and good sound quality.

Generally speaking, the electro-acoustic conversion efficiency of speakers with a 2-inch diameter is only 0.125%. That is to say: when the speaker's input electrical power is 1 W, only 0.00125 W electric energy is converted into useful sound energy; the remaining 0.99 W electric energy is converted into harmful thermal energy which people do not want and is completely wasted. Compared with the 7% energy conversion efficiency of incandescent lamp, the efficiency of 2-inch speaker is only the lamp's 1/56.

Therefore, moving-coil speaker (hereinafter referred to as speaker), the mainstream speaker, is the most widely used as well as the least efficient electrical products in human society worldwide in the 20th and 21st century.

Firstly, except for U.S. Pat. No. 5,748,760, almost all commercialized speakers worldwide have only one magnetic gap and one coil. When the coil is communicated with sound frequency current, according to Fleming's left hand rule, under the interaction of magnetic gap field, the coil will generate an electrical power F which drives the speaker's diaphragm to carry out reciprocating piston movement; the speaker will produce sound due to vibration of air. However, when the coil is going on reciprocating piston movement, the permanent magnetic force line in the magnetic gap will cut across the coil vertically, generating a dynamo electric potential by induction based on Fleming's right hand rule, that is what we call counter electromotive force. And the counter electromotive force will superpose the audio frequency signal in the speaker's coil, consequently leading to speaker distortion. In general, the larger the vibration amplitude of speaker's coil is, the larger the acceleration is, and the lower the frequency of audio signaling current is, the larger the amplitude of the counter electromotive force will be and the greater the distortion will be. Thus, constrained by distortion of counter electromotive force, the prior art is unlikely to enhance a speaker's efficiency. Secondly, although the prior art can be successfully applied to a full range speaker of medium or small caliber, the prior art cannot a full range speaker with a performance price that would be accepted by vast consumers and be put into mass industrial production. The fundamental reason lies in the fact that a speaker's impedance is a function of the speaker's working current frequency: the lower the frequency is, the lower the impedance will be; the higher the frequency is, the higher the impedance will be. For every traditional speaker having a single magnetic gap and a single coil, the effective value of high audio frequency current in the coil is much smaller than that of low audio frequency current. Thus, the sound pressure generated at the high audio frequency band of the speaker is less than that at the low audio frequency band. For a speaker with a caliber of less than 3 inches, we can make up for the defect through technical means since the mass of speaker's vibration system is relatively small But the resonant frequency $F_o$ of this sort of small-caliber speaker is necessarily higher, thus it is difficult to achieve satisfactory electronic acoustic recovery effect of low audio frequency. For speakers with a caliber of more than 3 inches, the increase in unit diameter will cause $F_o$ to drop towards low audio frequency, thus improving the speaker's low audio frequency recovery quality. But, the mass of the speaker's vibration system will increase; the speaker's SPL value of high audio frequency band will drop dramatically at the 5 to 10 KHz or above frequency band. Therefore, a high pitch speaker and a medium and bass speaker are usually mounted in the prior art multimedia sound system to satisfy customers' full range demand of $F_o$ to 20 KHz. In order to coordinate work of the two speakers, a frequency divider must be added. But the use of frequency divider will further lead to the sound system's energy consumption and distortion. Thirdly, U.S. Pat. No. 5,748,760 can not be applied to medium and small caliber speakers, such as the most widely used 0.5-inch to 8-inch caliber inside a magnet field speaker.

Fourthly, in spite of these, the USB sound of PC still has some widely acknowledged advantages. For instance, 1) the adoption of external sound card can completely get rid of the electromagnetic wave interference generated by transformer and electric fan inside computer case; 2) in terms of anti-interference, amplifier efficiency, signal to noise ratio and dynamic range, codec and coder based on PCM/PWM audio digital technology, D type audio power amplifier or T type audio power amplifier based on the 1 Bit Δ-Σ digital analog converter technology of DPPTM patent perform much better than complex wave filter, R/C blocking network and AB type power amplifier of simulated audio system; 3) Until now, the digital-analog or analog-digital conversional accuracy of mainstream sound card of computer's PCI is only 16 Bit, but the USB sound card's DAC of many mini USB audio often have an conversional accuracy of 20 Bit; 4) although the class of USB's universal serial bus is lower than PCI's parallel bus, the digital multimedia audio system characterized by USB/IEEE1394 (including derivative products such as 1394.b) interface technique will become the inevitable development trend of the future due to continuous improvement of CPU's performance, especially the emergency of CPU with dual or four core processors and the continuous enhancement of CPU function, the popularization of 2.0 USB interface standard as well as the forthcoming 3.0 USB interface standard.

For this reason, from 1997 the inventor started to put forward a series of invention patents with an attempt to change the above extremely unreasonable situation. They mainly consist of: A) authorized patents of the WO 01/15493 patent family including CN00122197.3, U.S. Pat. No. 6,795,564, CN200520035371.X, CN200620033128.9 and disclosed patent applications including JP publication 2003-531508, US20050099255, CN200510091936.0 and CN200610020317.7; B) authorized patents of the WO 99/31931 patent family including CN99114781.2, TW88109796 and CN00222469.0; C) undisclosed patent applications including CN200710181973.X, CN200710123821.4, CN200720126871.3, CN200810065384.X and CN200820092177.9.

For detailed information, please refer to the above disclosed patent literature.

SUMMARY OF THE INVENTION

The first aim of the present invention is to overcome technical prejudice and defects of prior art, and to provide a 2.0 audio channel digital multimedia sound system featured with high-efficiency energy saving, high-efficiency material saving and hi-fi quality, which is comprised by a single diaphragm full frequency band speaker with multi magnetic gaps and multi coils and with resistor load characteristic or similar resistor load characteristic, and also be powered by a USB or IEEE1394 interface.

The second aim of the present invention is to overcome technical prejudice and defects of prior art and to provide a 2.1 audio channel digital multimedia sound system featured with high-efficiency energy saving, high-efficiency material saving and hi-fi quality, which is comprised by a single diaphragm full frequency band speaker with multi magnetic gaps and multi coils and with resistor load characteristic or similar resistor load characteristic, and also be powered by the USB or IEEE1394 interface.

The third aim of the present invention is to overcome technical prejudice and defects of prior art and to provide a 4.1 to 7.1 channel digital multimedia sound system featured with high-efficiency energy saving, high-efficiency material saving and hi-fi quality, which is comprised by a single diaphragm full frequency band speaker with multi magnetic gaps and multi coils and with resistor load characteristic or similar resistor load characteristic, and powered by independent AC power, and the audio digital signal is provided by the USB or IEEE1394 interface.

The fourth aim of the present invention is to conquer the deficiency of prior art and to further improve and limit the technical features of existing speaker with multi magnetic gaps and multi coils. Also, the present invention aims at eliminating generator effect and counter electromotive force of the speaker and providing a series of full frequency band speakers of ultra high-efficiency and hi-fi quality, particularly providing a subwoofer with high efficiency, low distortion degree as well as resistor load characteristics or similar resistor load characteristics.

Please note that "CD-ROM game PS2" as used in the description herein refers to a game console such as the Playstation Two™ or the PS2™ that is developed by SONY COMPUTER ENTERTAINMENT INC™.

The aims of the present invention are realized as follows:

A multimedia sound system with digital audio interface, including at least one USB interface or IEEE1394 interface of computer or CD-ROM game PS2 or coaxial cable interface or fiber-optic interface of computer or CD-ROM game PS2; a set of 2.0 channel external sound cards for connecting the USB or IEEE1394 interface and the corresponding D type or T type IC chip of audio frequency power amplifier; a set of control and protection circuits which match the 2.0 channel external sound cards and the audio frequency power amplifier or IC chip of microprocessor and a pair of left and right channel speakers.

The 2.0 channel external sound card, the IC chip and related SMD (surface mount device) or integrated CMOS circuit, LED signal light which indicates the working condition of the external sound card, and the volume control device of the audio power amplifier shall be mounted on the PCB or connected to the PCB through wires and connectors. The PCB board shall be positioned inside the left channel speaker or the speaker supports, the LED signal light and the volume control device shall be fastened on speaker panel of the left channel speaker or on the speaker supports. The PCB board or the panel of the left speaker channel is set with a power socket which matches the interface, or connected to a computer through a plug of the interface's extension cable or to the interface of a CD-ROM game PS2. The panel of the right channel speaker is also mounted with an audio frequency power socket. An audio frequency cable connects the left and right channel speakers to form a 2.0 channel sound system.

The mentioned 2.0 channel external sound card has at least one set of stereo DAC of simplex 16 to 48 bits. DAC and IC chip above are powered by 5 V power supply from the computer USB interface, and each of them has a set of filtering and energy storage electrolytic capacitor in parallel at the places closest to their input pins. The specified lower limit of the rated working voltage for the audio power amplifier shall be 1.1 V to 2.7 V lower than that of DAC so as to make sure that both the transient working voltages of audio power amplifier and DAC basically do not exceed the lower limit of the rated working voltage when the speaker output a large dynamic low audio signal of sufficiently large width.

The left and right channel speakers have at least one multi magnetic gaps and multi coils built in speaker featured with resistor loads or similar resistor loads. The specified speaker shall be only equipped with a cone-shaped or concave diaphragm with the caliber equal to or less than 7 inches. Besides, the specified cone-shaped diaphragm is required to have a central hole with the diameter of not more than 26 to 33 millimeters ("mm"), which thereby constitutes full frequency band speaker having two single-point coaxial sound production, and multi magnetic gaps and multi coils speaker and counter electromotive force obtained in its reciprocating motion offset each other due to the phase angle of 180 degree.

The specified rated working voltage of the audio power amplifier is ≤DC 5.2V or DC8~15V, and the rated continuous power of its each channel is ≤1 W or 2 W. Thus, 2.0 channel digital multimedia sound system with ultra-high sensitivity and hi-fi quality and powered by the USB interface or IEEE1394 interface, has been formed.

The multimedia sound system with digital audio interfaces includes: At least one USB interface or IEEE 1394 interface or coaxial cable interface or optical interface of computer or CD-ROM game PS2, a set of 2.1 channel external sound cards connected by the USB or IEEE1394 interface with the matched chips of D type or T type IC chip for 2.1 channel audio power amplifier and a set of matched protective control circuits or IC chips of the microprocessor for the 2.1 channel external sound card and audio power amplifier, as well as a pair of left and right channel speakers and a subwoofer.

The 2.1 channel external sound card, the IC chip and related SMD (surface mount device) or integrated CMOS circuits, LED signal light indicating the operation of the external sound card and the volume control device for 2.1 channel audio power amplifier are mounted on the PCB board. The PCB, the LED signal light and volume control device are mounted in the subwoofer or on its panel, where a socket matching the interfaces is mounted. The interfaces are connected to computer or CD-ROM game PS2 via the plug of an interface extension cable. There is also an audio jack on the panels of the left and right channel speakers, which are connected to the subwoofer via two audio cables to make a 2.1 channel sound system.

The 2.1 channel external sound card has at least one set of 2.1 channel DAC decoders of simplex 16 to 48 bits, wherein the signal of the left and right channels is connected to the IC chip of the left and right channels audio power amplifier via the DAC, while another route of analog signal of subwoofer channel is connected to the subwoofer audio power amplifier via the electrical crossover with band-pass width of 20 Hz to 250 Hz.

When the computer is a PC, the DAC and the audio power amplifiers of the left and right channels are powered by 5 V power supply from one USB interface of the PC, while the subwoofer audio power amplifier is powered by 5 V power supply from another USB interface of the PC. When the computer is a Mac, the DAC, the audio power amplifier of the left and right channels, the crossover and the subwoofer audio power amplifier are all powered by the same IEEE 1394 interface with the DC 8 V to 15 V.

The DAC and IC chip of audio power amplifier of the left and right channels are powered by 5 V power supply from a computer USB interface, and each the DAC and IC chip have a set of filtering and energy storage electrolytic capacitor in parallel at the places closest to their input pins respectively. The specified lower limit of the rated working voltage for the audio power amplifier shall be 1.1 V to 2.7 V lower than that of DAC so as to make sure that both the transient working voltages of audio power amplifier and DAC basically do not exceed the lower limit of the rated working voltage when the described speaker output a large dynamic low audio signal of sufficiently large width.

The IC chip of the subwoofer audio power amplifier alone parallelly connects to a set of filtering and energy storage electrolytic capacitor of 1,000 μF to 100,000 μF or less at the places closest to power input pins.

The left and right channels have at least one multi magnetic gaps and multi coils built in speaker featured with resistor loads or similar resistor load. The specified speaker shall be only equipped with a cone-shaped or concave diaphragm with the caliber equal to or less than 7 inches. The specified cone-shaped diaphragm is required to have a central hole with the diameter of not more than 26 to 33 mm, which thereby constitutes full frequency band speaker having two single-point coaxial sound production. And multi magnetic gaps and multi coils speaker and counter electromotive force obtained in its reciprocating motion offset each other due to the phase angle of 180 degree.

The subwoofer has one multi magnetic gaps and multi coils built in speaker featured with resistor loads or similar resistor load. The specified speaker shall be only equipped with a cone-shaped or concave diaphragm with the caliber equal to or less than 7 inches. The specified cone-shaped diaphragm is required to have a central hole with the diameter of not more than 26 to 33 mm, which thereby constitutes full frequency band speaker having one single-point coaxial sound production. And multi magnetic gaps and multi coils speaker and counter electromotive force obtained in its reciprocating motion offset each other due to the phase angle of 180 degree.

The specified rated working voltage of the audio power amplifier is equal to or less than DC 5.25V or DC 8-15V, the specified rated continuous output power of each left and right channel is equal to or less than 1 W or 2 W, and the specified rated continuous output power of subwoofer audio power amplifier is equal to or less than 2 W or 4 W. Thus, 2.1 channel digital multimedia sound system with ultra-high sensitivity and hi-fi quality and powered by the USB or IEEE 1394 interfaces, has been formed.

The multimedia sound system with digital audio interfaces includes: At least one USB interface or IEEE1394 interface or coaxial cable interface or optical interface of computer or CD-ROM game PS2, a set of 4.1 to 7.1 channel external sound cards connected by the USB or IEEE1394 interface or with the matched chips of D type or T type for the 4.1 to 7.1 channel audio power amplifier, and a set of the matched protective control circuits or IC chip of the microprocessor for the 4.1 to 7.1 channel external sound card and the audio power amplifier, as well as 4 to 7 satellite speakers and a subwoofer.

The above 4.1 to 7.1 channel external sound card, IC chip and related SMD or integrated CMOS circuits, indicating that LED signal light for the operation of the external sound card and the volume control device for 4.1 to 7.1 channel audio power amplifier are mounted on the PCB board. The PCB, LED signal light and volume control device should be mounted in the subwoofer or on its panel, where a socket matching the interfaces is mounted. The interfaces are connected to computer or CD-ROM game PS2 via the plug of an interface extension cable. There is an audio jack on the panels of the above 4 to 7 satellite speakers respectively, which are connected to the subwoofer via the 4 to 7 audio cables to make a 4.1 to 7.1 channel sound system.

The 4.1 to 7.1 channel external sound card has at least one set of 4.1 to 7.1 channel digital analog decoder DAC of simplex 16 to 48 Bit, wherein the signal of the 4.1 to 7.1 channel is connected to the matched IC chip in the 4.1 to 7.1 channel audio power amplifier via the DAC, while the analog signal of subwoofer channel is connected to the heavy bass audio power amplifier via the electrical crossover with band-pass width of 20 Hz up to 250 Hz.

The 4.1 to 7.1 channel external sound card is powered by the USB interface or IEEE1394 interface. The 4 to 7 channel audio power amplifier, bass audio power amplifier, controlling and protecting circuit or IC chip of microprocessor are independently powered by AC/DC power supply built in the subwoofer. The DAC and IC chips of the 4 to 7 audio power amplifiers have a set of filtering and energy storage electrolytic capacitor in parallel at the places closest to their input pins in order to make sure that both the transient working voltages of audio power amplifier and DAC basically do not exceed the lower limit of the rated working voltage when the described speaker output a dynamic low audio signal of sufficiently large width.

The IC chip of the heavy bass audio power amplifier alone parallelly connects to a set discharge circuit of filtering and energy storage electrolytic capacitor of 1000 μF to 100000 μF or less at the places closest to power input pins.

The 4 to 7 satellite speakers have at least one multi magnetic gaps and multi coils built in speaker featured with resistor loads or similar resistor load respectively. The specified speaker shall be only equipped with a cone-shaped or concave diaphragm with the caliber equal to or less than 7 inches, the specified cone-shaped diaphragm is required to have a central hole with the diameter of not more than 26 to 33 mm, which thereby constitutes full frequency band speaker having 4 to 7 single-point coaxial sound production. And multi magnetic gaps and multi coils speaker and counter electromotive force obtained in its reciprocating motion offset each other due to the phase angle of 180 degrees.

The subwoofer has one multi magnetic gaps and multi coils built in speaker featured with resistor loads or similar resistor load. The specified speaker shall be only equipped with a cone-shaped or concave diaphragm with the caliber equal to or less than 10 inches. The specified cone-shaped diaphragm is required to have a central hole with the diameter of not more than 26 to 33 mm, which thereby constitutes full frequency band speaker having one single-point coaxial sound production. And multi magnetic gaps and multi coils speaker and counter electromotive force obtained in its reciprocating motion offset each other due to the phase angle of 180 degrees.

The specified rated continuous output power of 4 to 7 channels audio power amplifier is less than or equal to 1 W, and the specified rated continuous output power of heavy bass audio power amplifier is less than or equal to 4 W or 8 W. Thus, a 4.1 to 7.1 channel digital multimedia sound system with ultra-high sensitivity and hi-fi quality and powered by independent AC/DC power supply, has been formed.

For a multimedia sound system with a digital audio interface, all the elements and devices of a subwoofer of the system, except for a band pass filter of the subwoofer, that are mounted in the subwoofer can be segregated from the subwoofer and used to form an independent power amplifier. The independent power amplifier comprises at least one indicating and regulating device, at least one audio input interface and at least one audio output jack mounted on the independent power amplifier panel. Both panels of the 4 to 7 satellite speakers and the subwoofer are respectively mounted with an audio jack. 5 to 8 audio cables connect the independent power amplifier and the (4+1) to (7+1) speakers into 4.1(+1) to 7.1(+1) channel digital multimedia sound system.

For a multimedia sound system with a digital audio interface, its specified multi magnetic gaps and multi coils speaker refers to dual-magnetic gaps and a dual-coil. The speaker has upper and lower polar plates mounted coaxially and positioned symmetrically. The upper and lower polar plates are circular panels with a central axis hole. A round sheet magnet or NdFeB magnet which is magnetized and that has a polarization in a thickness direction that is clamped between the upper polar plate and the lower polar plate and that matches each other. In terms of axial height, a ring-shaped magnetic yoke that is mounted coaxially with the above upper and lower polar plates exceeds a lateral polar plane of the upper and lower polar plates respectively by 0.5 to 8 mm, thus forming two groups of magnetic gap circuits characterized by a complete longitudinal symmetry. The external peripheral face of the ring-shaped magnetic yoke and a vertical peripheral face of the upper and the lower polar plates constitute two coaxial ring-shaped magnetic gaps with equal diameter. Two equal diameter coaxial coils shall be inserted into the ring-shaped magnetic gaps. The coils shall be made by winding one or two layers of magnetic wires; the gap between the two coils shall be left with appropriate space; the winding direction of the coil and the direction of the current flowing through the coil shall be prescribed so that the two coils will generate electromotive force F in the same direction at the same working instant.

When the central axis of the upper and the lower polar plates is chosen as the vertical symmetry axis and the bisector X-X at one-half axial height of at least one of the round sheet magnet and the NdFeB magnet is chosen as the horizontal axis of symmetry, the speaker will have a magnetic circuit marked by bilateral and up-down symmetry in terms of geometrical shape and magnetic property.

The cross section area, number of turns, coil winding depth, coil resistance, the absolute value of the coils inductance, and winding tension of the two coils shall be equal with each other. And while the bisector X-X at one-half axial height of the magnet or NdFeB magnet is chosen as the horizontal axis of symmetry, the speaker would have two sets of coil circuits which are longitudinal symmetry. Thus, a full frequency band outer-magnet speaker of dual-magnetic gaps and dual-coil or a band-pass bass speaker is formed and marked by resistor or similar load characteristic.

For multimedia sound system with digital audio interface, its specified multi magnetic gaps and multi coils speaker refers to dual-magnetic gaps and dual-coil one. The speaker has upper and lower polar plates mounted coaxially and positioned symmetrically. The upper and lower polar plates are two circular panels. A round sheet magnet or NdFeB magnet which is magnetized and polarization in thickness direction is clamped between upper polar plate and lower polar plate, and match each other. In terms of axial height, a ring-shaped magnetic yoke which is mounted coaxially with the above upper and lower polar plates exceeds the lateral polar plane of the upper and lower polar plates respectively by 0.5 to 8 mm, thus forming two groups of magnetic gap circuits characterized by complete longitudinal symmetry. The internal peripheral face of the ring-shaped magnetic yoke and the vertical peripheral face of the upper and the lower polar plates constitute two coaxial ring-shaped magnetic gaps with equal diameter. Two equal diameter coaxial coils shall be inserted into the ring-shaped magnetic gaps. The coils shall be made by winding one or two layers of magnetic wires; the gap between the two coils shall be left with appropriate space; the winding direction of the coil and the direction of the current flowing through the coil shall be prescribed so that the two coils will generate electromotive force F in the same direction at the same working instant.

When the central axis of the upper and the lower polar plates is chosen as the vertical symmetry axis and the bisector X-X at one-half axial height of magnet and NdFeB magnet is chosen as the horizontal axis of symmetry, the speaker will have a magnetic circuit marked by bilateral and up-down symmetry in terms of geometrical shape and magnetic property.

The cross section area, number of turns, coil winding depth, coil resistance, the absolute value of the coils inductance, and winding tension of two coils shall be equal with each other. And while the bisector X-X at one-half axial height of the magnet or NdFeB magnet is chosen as the horizontal axis of symmetry, the speaker would have two sets of coil circuits which are longitudinal symmetry. Thus, a full frequency band inner-magnet speaker of dual-magnetic gaps and dual-coil or a band-pass bass speaker is formed and marked by resistor or similar load characteristic.

For the multimedia sound system with digital audio interface, the multi magnetic gaps and multi coils speaker refers to three magnetic gaps and three coils one, and both sides of the circular plate made of magnetic material shall be respectively mounted with a round sheet magnet or NdFeB magnet which is used for magnetizing and polarizing in the thickness direction. The magnet has the same polarity on the side close to the plate; circular plates made of magnetic material shall be mounted separately on the lateral face of the magnet; thus a pair of repulsion magnet is formed. The three circular plates mounted coaxially have the same projected area and can match the projected plane of the two coaxially mounted magnets. In terms of axial height, a ring-shaped magnetic yoke which is mounted coaxially with the central axis of the circular plate exceeds the lateral polar plane of the lateral circular plate respectively by 0.5 to 8 mm, thus forming two groups of magnetic gap circuits characterized by complete longitudinal symmetry. The internal peripheral face of the ring-shaped magnetic yoke and the vertical peripheral face of the circular plate constitute three coaxial ring-shaped magnetic gaps with equal diameter. Three equal diameter coaxial coils with the same cross-sectional area as the magnetic wire shall be inserted into the ring-shaped magnetic gaps. The coils shall be made by winding one or two layers of magnetic wires; the gap between the three coils shall be left with appropriate space; the winding direction of the coil and the direction of the current flowing through the coil shall be prescribed so that the three coils will generate electromotive force F in the same direction at the same working instant.

When the central axis of the circular plate is chosen as the vertical symmetry axis and the bisector X-X at one-half axial height of the central plate is chosen as the horizontal axis of symmetry, the speaker will have a magnetic circuit marked by bilateral and up-down symmetry in terms of geometrical shape and magnetic property.

The coil resistance, the coil winding depth, the absolute value of the coil inductance, and winding tension shall be equal. When the bisector X-X at the one-half axial height of the central plate is chosen as the horizontal axis of symmetry, the speaker has two sets of coil circuits which are longitudinal symmetry. Thus, a full frequency band inner-magnet speaker of three magnetic gaps and three coils or a band-pass bass speaker is formed and marked by resistor or similar load characteristic.

For the multimedia sound system with digital audio interface, the axis position of the three plates of the inner-magnet speaker with three magnetic gaps and three coils, and the axis position of the two magnets are all equipped with central axis holes of equal projected areas. The axis position of the speaker's support which is made of non-magnetic material also has a central axis hole of the same projected area or has a matching screw hole. A fastener made of non-magnetic material will pass through the axis hole or the matching screw hole; a pressure plate made of non-magnetic material which matches the plate will exert enough static pressure on the plate and the magnet so as to fasten them firmly at the speaker's support.

For the multimedia sound system with digital audio interface, the multi magnetic gaps and multi coils speaker refers to the one with four or more than four magnetic gaps and coils, and both sides of the circular plate of magnetic material shall be separately mounted with a round sheet magnet or NdFeB magnet which is used for magnetizing and polarizing in the thickness direction. The magnet has the same polarity on the side close to the plate; circular plates made of magnetic material shall be mounted separately on the lateral sides of the magnet; thus three or more than three pairs of repulsion magnet are formed. The four or more than four circular plates mounted coaxially have the same projected area and can match the projected plane of the three or more than three coaxially mounted magnets. In terms of axial height, a ring-shaped magnetic yoke which is mounted coaxially with the central axis of the circular plate will exceed the lateral polar plane of the lateral circular plate respectively by 0.5 to 8 mm, thus forming two sets of magnetic gap circuits characterized by complete longitudinal symmetry. The internal peripheral face of the ring-shaped magnetic yoke which is mounted coaxially with the repulsion magnet and the vertical peripheral face of the circular plate constitute four or more than four coaxial ring-shaped magnetic gaps with equal diameter. Four or more than four equal diameter coaxial coils with the same cross-sectional area as the magnetic wire shall be inserted into the ring-shaped magnetic gaps. The gap between the coils shall be left with appropriate space; the winding direction of the coil and the direction of the current flowing through the coil shall be prescribed so that the coils will generate electromotive force F in the same direction at the same working instant.

When the central axis of the circular plate is chosen as the vertical symmetry axis and the bisector X-X at one-half axial height of the central plate is chosen as the horizontal axis of symmetry, the speaker will have three or more than three magnetic circuits marked by bilateral and up-down symmetry in terms of geometrical shape and magnetic property.

Viewed in the lateral direction of the diaphragm, if the coil 609A and 609C revolves clockwise, the coil 609B and 609D must revolve anticlockwise and vice versa. The tail end YA of the coil 609A shall be connected in series with the head end XB of the 609B coil; the tail end YB of the coil 609B shall be connected in series with head end XC of the 609C coil; The tail end YC of the coil 609C shall be connected in series with head end XD of the 609D coil; the end YD of the coil 609D shall be leaded upward along the coil's support and be connected in series with head end of the 609A coil, thus forming a pair of signal input terminals of the transducer. The cross-sectional area of magnet wire, the winding number, the winding depth, the resistance as well as the inductance of the coil 609A and 609D and the coil 609B and 609C shall be equal in absolute value, i.e., |609A|+|609B|=|609D|+|609C| and the winding tensions shall be equal. When the bisector X-X at one-half axial height of the central magnet is chosen as the horizontal axis of symmetry, the speaker will have two sets of coil circuits which are longitudinal symmetry. Thus, a full frequency band inner-magnet speaker of four or more than four magnetic gaps and coils or a band-pass bass speaker is formed and marked by resistor or similar load characteristic.

For the multimedia sound system with digital audio interface, the axis position of the four or more than four plates of the inner-magnet speaker with four magnetic gaps and four coils, and the axis position of the three or more than three magnets are all equipped with central axis holes of equal projected areas. The axis position of the speaker's support which is made of non-magnetic material also has a central axis hole of the same projected area or has a matching screw hole. A fastener made of non-magnetic material will pass through the axis hole or the matching screw hole; a pressure plate made of non-magnetic material which matches the plate will exert enough static pressure on the plate and the magnet so as to fasten them firmly at the speaker's support.

DESCRIPTION OF FIGURES

FIG. 11: Working principle diagram of EMF offset in symmetric magnetic circuit and symmetric coil circuit;

FIG. 12: Wiring diagram of coil circuit principle of dual-magnetic gaps and dual-coil speaker;

FIG. 15: Wiring diagram of coil circuit principle of four-magnetic gap and four-coil speaker;

FIG. 16: Embodiment diagram of 2.0 channel multimedia sound system;

FIG. 17: Embodiment diagram of 2.1 channel multimedia sound system;

FIG. 20: Working principle diagram of audio current and EMF of prior art's single magnetic gap and single coil speaker;

FIG. 21: Working principle diagram of audio current and EMF of speaker with multi magnetic gaps and coils in symmetric magnetic circuit and symmetric coil circuit.

Correspondence between main elements and reference numbers in the present invention from FIG. 6 to FIG. 15, FIG. 18, and FIG. 19

| | | |
|---|---|---|
| Polar plane - 100~600; | Framework - 10~601; | Framework ring-shaped platform - 1013~6013; |
| Framework installation screw hole - 1061~6061; | | Framework flange - 1011~6011; |
| Framework flange or sleeve - 1012~6012; | | Polar plate - 103~603; |
| Permanent magnet - 102~602; | ring-shaped magnetic yoke - 113~613; | Ring-shaped magnetic gaps - 110~610; |
| magnetic lines of force of ring-shaped magnetic gap - 1991~6991; | Coil - 109~609; | Coil skeleton - 107~607; |
| Non-magnetic support - 181~681; | convex circular platform of the support - 1118~6118; | convex circular platform of the support - 11180~61180; |
| Vertical locating face of support's ring-shaped thin wall - 1820~6820; | | Support's horizontal locating face - 1810~6810; |
| Adhesive - 1811~6811; | Elastic wave - 141~641; | Diaphragm - 106~606; |
| Dust cap - 105~605; | Dangling edge - 199~699; | Ring-shaped groove - 1631~6631; |
| Penetration pore - 182~682; | Fastener of non-magnetic material - 3710~6710; | |
| Non-magnetic pressure plate - 182~6820 | | Non-magnetic nut - 375~675 |

Figure 5:
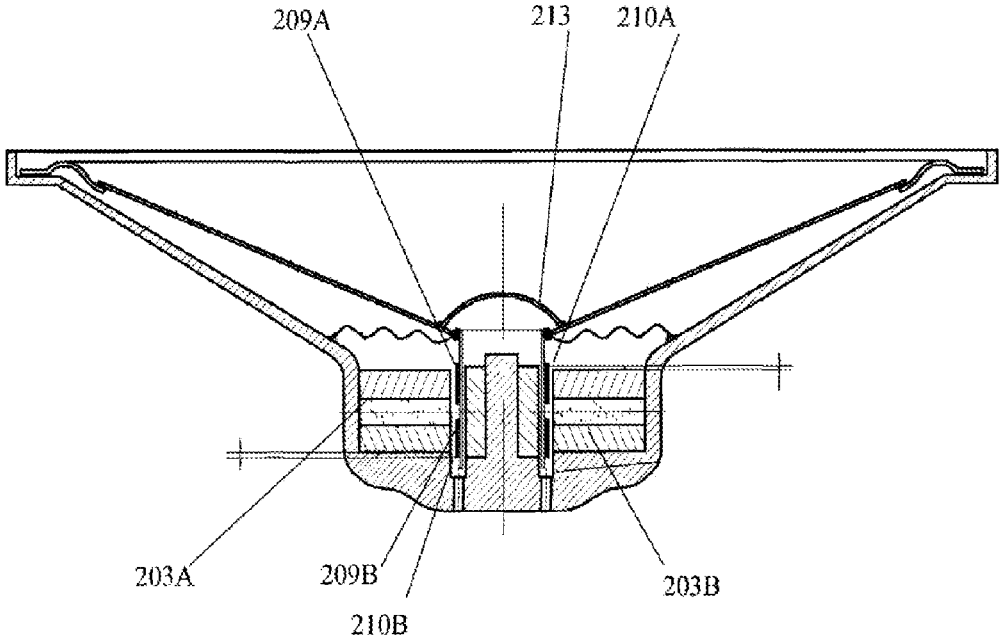
FIG. 5: Longitudinal diagram of the embodiment of dual-magnetic gaps and dual-coil outer-magnet speaker.

For element and reference number table in FIG. 5 of the present invention, please refer to the manual of CN200610020317.7. In order to gain a clearer understanding of the invention's new technical scheme, illustration will be given as follows in conjunction with the description of figures.

EMBODIMENTS

Figure 1:
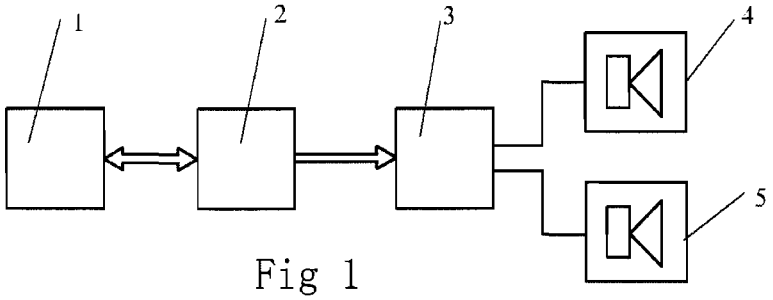
FIG. 1: Block diagram of the 2.0 channel multimedia sound system with digital audio interface.

FIG. 1 shows the block diagram of the 2.0 channel multimedia sound system with digital audio interface of the present invention.

Element 1, a computer or CD game PS2, provides DC 5V or 8-12V power or digital audio signal level for DAC 2 or a group of D type or T type audio power amplifiers through one USB interface or IEEE1394 interface or coaxial cable or fiber interface. Thus, an external USB simplex soft sound card or IEEE1394 simplex soft sound card implemented or controlled by universal serial data bus for computer or PS2 forms. The continuous output power of D type or T type power amplifier 3 is 2.0 channel audio analog power of 2.times.1 W or so which transfers to right speaker 5 through left speaker 4. Its basic structure and operation principle are the same as those of USB sound system with the prior art.

Figure 2:
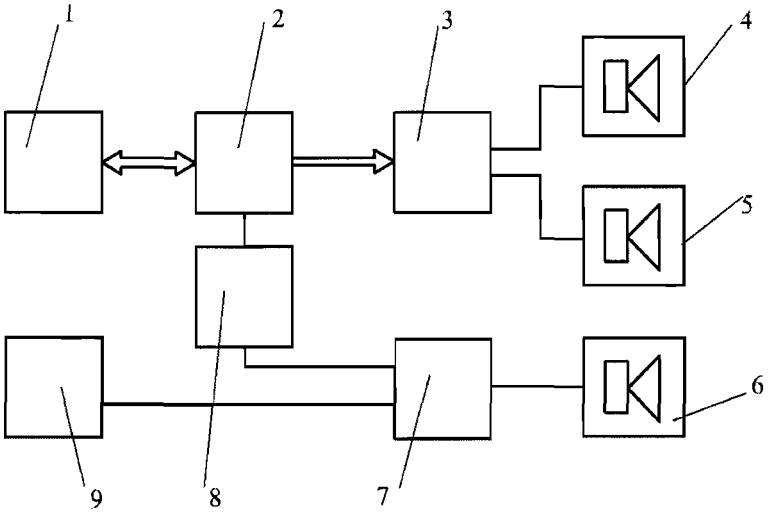
FIG. 2: Block diagram of the 2.1 channel multimedia sound system with digital audio interface.

FIG. 2 shows the block diagram of the 2.1 channel multimedia sound system with digital audio interface of the present invention.

Element 1 to 5 of FIG. 2 are the same as Element 1 to 5 of FIG. 1. Element 6 of FIG. 2 is a subwoofer (woofer), element 8 is an electronic frequency divider, and their band pass width are selected and used between 20 Hz and 250 Hz. Element 7 is a D type or T type heavy bass audio power amplifier, and element 9 is another group of USB interfaces of the same PC or CD-ROM game PS2 which provide alone DC 5V power for the heavy bass audio power amplifier. If a USB 2.0 interface standard is adopted, the maximum continuous input power of speaker in right and left channel in FIG. 2 is about ≤2×1 W, and the maximum continuous input power of heavy bass speaker is about ≤1×2 W. If a USB 3.0 interface standard is adopted, the maximum continuous input power of 2.0 sound channel multimedia audio system in FIG. 1 is about ≤2×2 W, and the maximum continuous input power of heavy bass speaker is about ≤1×4 W.

Figure 3:
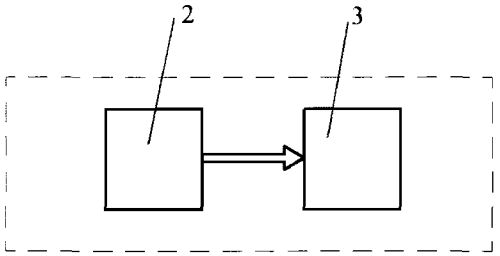
FIG. 3: The integrated block diagram of the analog to digital converter (ADC) and the digital audio power amplifier.

FIG. 3 shows the integrated block diagram of the analog to digital converter (ADC) and the digital audio power amplifier.

Audio digital decoder (DAC) 2 and a group of D type or T type audio power amplifier 3 are integrated within the same chip. For example, CM6120S IC chip of C-media Electronics, Inc. integrates DAC and audio power amplifier 3 of the right and left channels as well as auxiliary circuits, such as: corresponding crystal oscillator circuit, overload heat protection, short-circuit protection into the same chip IC.

Figure 4:
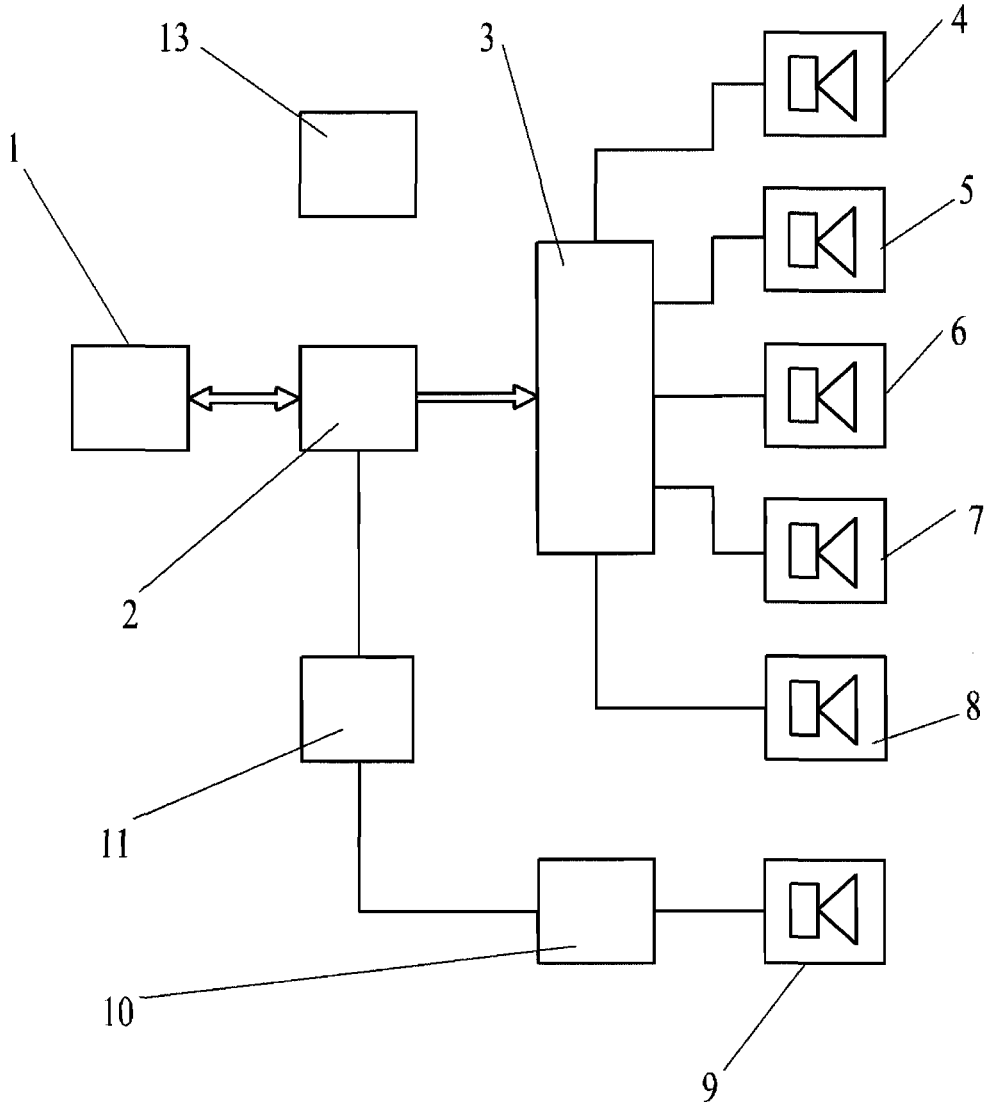
FIG. 4: Block diagram of the 5.1 channel multimedia sound system with digital audio interface.

FIG. 4 shows the block diagram of the 5.1 channel multimedia sound system with digital audio interface of the present invention.

Element 1, 2, and 3 of FIG. 2 are the same as element 1, 2, and 3 of FIG. 1. Element 4 to 8 of FIG. 2 are five satellite speakers which are front L, center, front right, left surround and right surround speaker. Element 11 of FIG. 2 is an electronic frequency divider, and its band width is selected and configured according to demands between 20 Hz and 250 Hz. Element 10 is a D type or T type heavy bass audio power amplifier, and its analog output current is connected with heavy bass speaker 9. Element 13 is an independent AC/DC power supply or battery set which provide essential DC power for all elements or other elements except element 2.

According to block diagram shown in FIG. 4, the present invention may also be applicable for 4.1, 7.1 channel digital multimedia sound system only if appropriate number of satellite speakers is adapted.

FIG. 5 shows the longitudinal diagram of the embodiment of dual-magnetic gaps and dual-coil outer-magnet speaker of the present invention.

This is a technical improvement scheme made on the basis of CN200610020317.7 patent application which is put forward by the inventor. One ring-shaped magnetic yoke 213 coaxially mounted together with upper polar plate 203A and lower polar plate 203B exceeds H=0.5 mm to 8 mm above lateral face of the upper polar plate and lower polar plate and forms two groups of magnetic gap circuit characterized by complete longitudinal symmetry. External peripheral face of the ring-shaped magnetic yoke 213 and vertical peripheral face of central axis hole of both upper polar plate 203A and lower polar plate 203B consist of two coaxial ring-shaped magnetic gap 210A and 210B with same diameter. Within such two ring-shaped magnetic gap, two coaxial coils 209A and 209B with same diameter are inserted; the coil is wound with one or two layers of magnetic coil; corresponding intervals are set between two coils 209A and 209B; winding direction of two coils and current direction of running through coil are regulated, enabling two coils 209A and 209B to produce electromotive force F in the same direction in the same working instant.

The central axis of central axis hole of upper polar plate 203A and lower polar plate 203B is taken as vertical symmetry axis, and bisector X-X axis of axial height, ½ of NdFeB magnet, is taken as horizontal symmetry axis. The speaker is provided with two groups of symmetrical magnetic circuit that are symmetrical on the left and right as well as from the top to the bottom in the geometrical and magnetic performance aspect; it is regulated that the cross sectional area, number of coil turns, coil winding depth, coil resistance, absolute value of coil inductance, and winding tension of two coils 209A and 209B are equal to each other; bisector X-X axis of axial height, ½ of NdFeB magnet, is taken as horizontal symmetry axis; the speaker is provided with two groups of coil circuits characterized by longitudinal symmetry. Thus, inductance as well as counter electromotive force obtained during reciprocating type motion course of two coils 209A and 209B for the embodiment of the present invention offset each other due to 180 degree phase angle. The speaker described by the embodiment is a multi magnetic gaps and multi coils speaker featured with resistor load or similar one and with high sensitivity and hi-fi quality.

Figure 6:
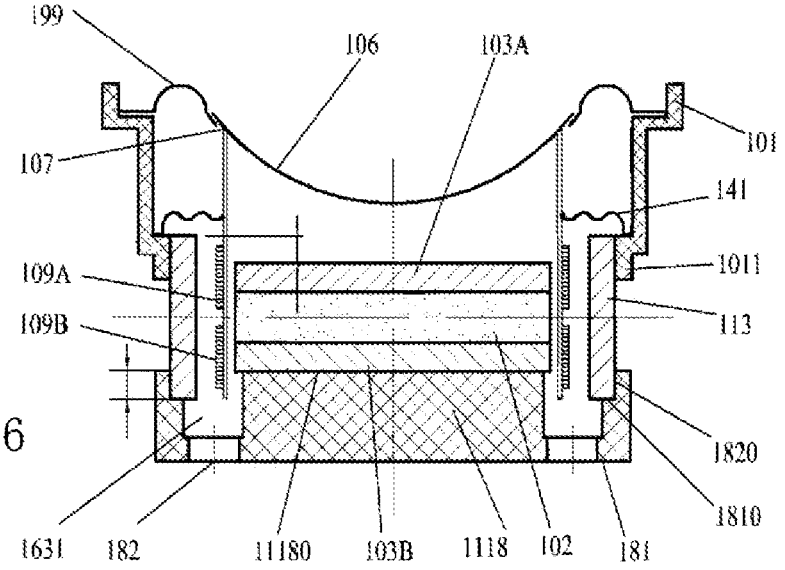
FIG. 6: Longitudinal diagram of the embodiment of dual-magnetic gaps and dual-coil inner-magnet speaker.

FIG. 6 shows longitudinal diagram of the embodiment of dual-magnetic gaps and dual-coil inner-magnet speaker of the present invention Upper polar plate 103A and lower polar plate 103B are two circular plates coaxially mounted of which thickness are equal, projected areas are equal, and a piece of B magnet 102 matched with it is clamped between element 103A and 103B. An concave circular platform 1118 which is equipped with in the axis part of support 181 made of aluminum alloy is provided with smooth and neat vertical and external circular face, its diameter matches with those of element 103A and 103B. A ring-shaped groove 1631 is equipped with at the outside of element 1118, multi penetration holes 182 laid out evenly are provided with at the bottom of the groove, the outside of element 1631 is an ring-shaped thin wall of support 181 which is equipped with smooth and neat internal and external vertical plane. A smooth and neat horizontal locating face 1810 and a vertical locating face 1820 are also equipped with an axial height of ring-shaped thin wall of support 181.

Adhesive is coated on horizontal installation face 11180 of element 1118 and magnetic core that is stuck together and filled with magnetic polarization such as element 103A, 102 and 103B are put on the face and installation and location is guaranteed to be at the axis part of element 11180. After adhesive is solidified, ring-shaped magnet yoke 113 is mounted on coaxial part of magnetic core and bound and fixed on axis part of support 181. Meanwhile, two top and down end face of element 113 have the same H value (0-8 mm) as lateral polar face of element 103A and 103B, internal flank of element 113 and vertical flank of element 103A and 103B consist of two coaxial and isometric ring-shaped magnetic gaps 110A and 110B. The top part of element 113 is embedded within circular axis hole at the bottom of plastic frame 101, and external wall of element 113 is bound and fixed by adhesive and flange 1011 at the bottom of frame.

The coil frame 107 of the ring-shaped magnetic gap and two coils 109A and 109B which are wound by one or two layer of magnetic wire are inserted into ring-shaped magnetic gap. For example, seen from diaphragm 106 direction, coil 109A is set as clockwise winding direction, and coil 109B is counter clockwise winding direction (vice versa). It is regulated that magnetic wire cross sectional area, numbers of coil turn, coil winding depth, coil resistance, absolute value of coil inductance, and winding tension of coil 109A and 109B are equal to each other. Thus the bisector X-X axis of axial height ½ of element 102 is taken as horizontal symmetry axis. Two groups of magnetic circuit and coil circuit taking central axis of element 103A, 102 and 103B as vertical symmetry axis that are symmetrical from top to down as well as on the right and left in the geometrical and magnetic performance aspect. Then, elastic wave 141, coil skeleton 107, diaphragm 106 as well as dangling edge 199 and frame 101 are bound and fixed together.

Figure 10:
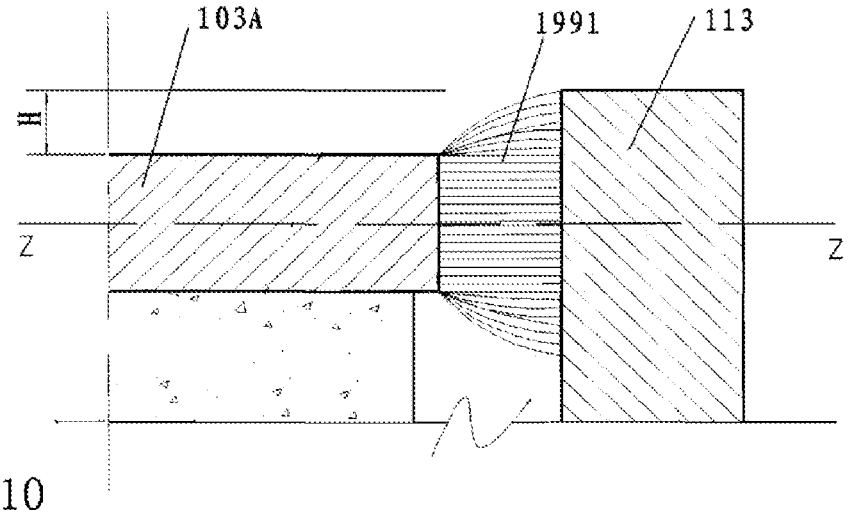
FIG. 10: Schematic diagram of magnetic gap and magnetic line of force distribution of lateral polar plate of the present invention.
Figure 13B:
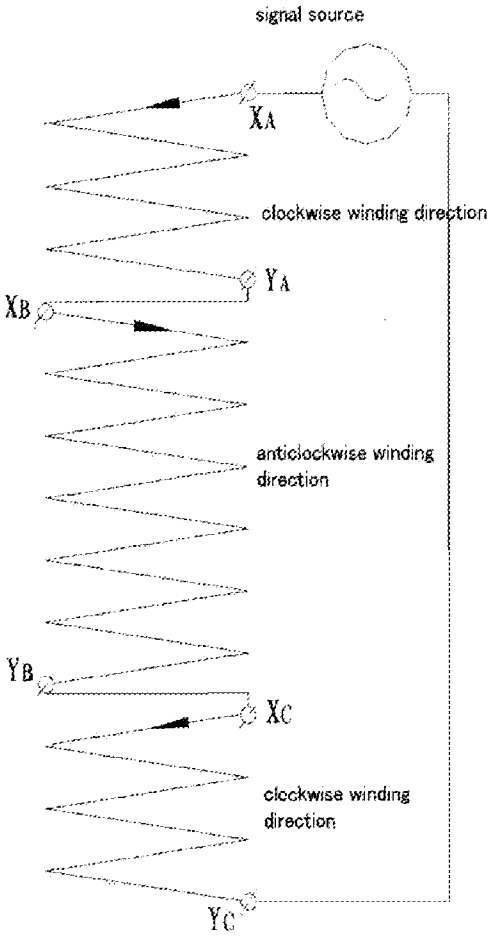
FIG. 13: Wiring diagram (I) of coil circuit principle of three-magnetic gap and three-coil speaker.
Figure 13A:
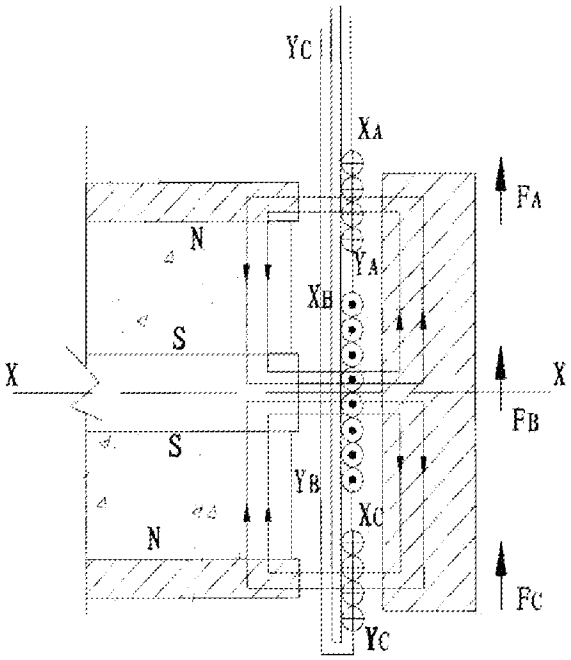
Figure 14B:
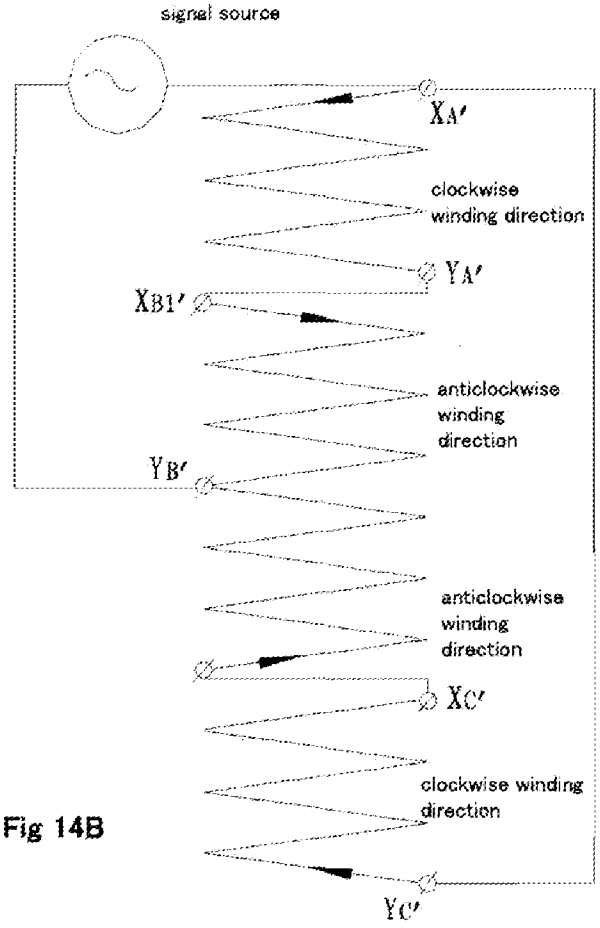
FIG. 14: Wiring diagram (II) of coil circuit principle of three-magnetic gap and three-coil speaker.
Figure 14A:
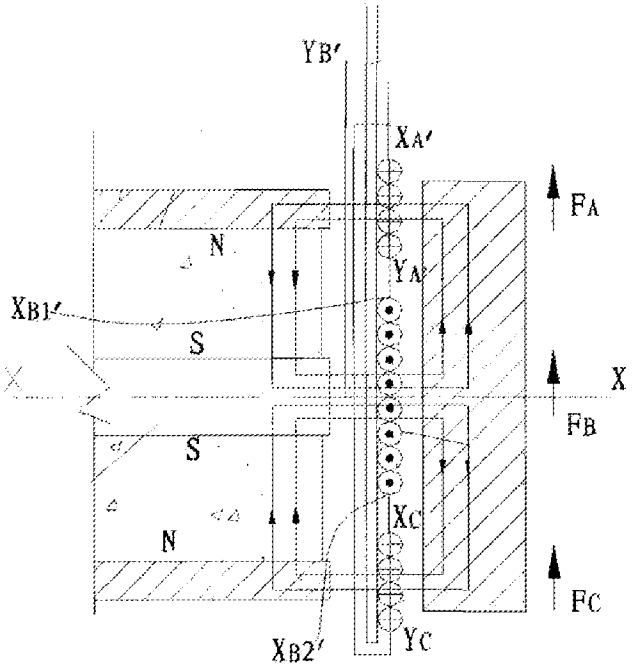

Refer to FIG. 10, if distance between lateral side of element 103A and 103B and two end face of element 113 is H value which is above 0.4 mm, two groups of magnetic gap symmetrical magnetic circuits that take bisector Z-Z axis of ½ axial height for element 103A and 103B as symmetry axis. The magnetic line of force 1991 is magnetic gap is as shown in FIG. 10. Thus, inductance as well as counter electromotive force obtained during reciprocating type motion course of two coils 209A and 209B for the embodiment of the present invention offset each other due to 180 degree phase angle. The speaker described by the embodiment is a multi magnetic gaps and multi coils speaker featured with resistor load or similar one and with high sensitivity and hi-fi quality.

FIG. 12 shows coil circuit wring principle diagram of dual-magnetic gaps and dual-coil speaker.

FIG. 6 as an embodiment: magnetic wire cross sectional area, number of coil turn, coil winding depth, coil resistance, absolute value of coil inductance, winding tension of coil 109A and 109B are equal to each other but the winding directions are opposite, therefore, vector value of inductance |L109A| and |L109B| when audio current passes through the coil 109A and 109B, but phase angle is 180 degrees, thus enabling inductance in symmetrical coil circuit to be equal to zero or close to be zero, and speaker is featured with resistor load or similar resistor load. Undoubtedly, out-magnet speaker of the embodiment of the present invention in FIG. 5 can be carried out according to this.

Figure 7:
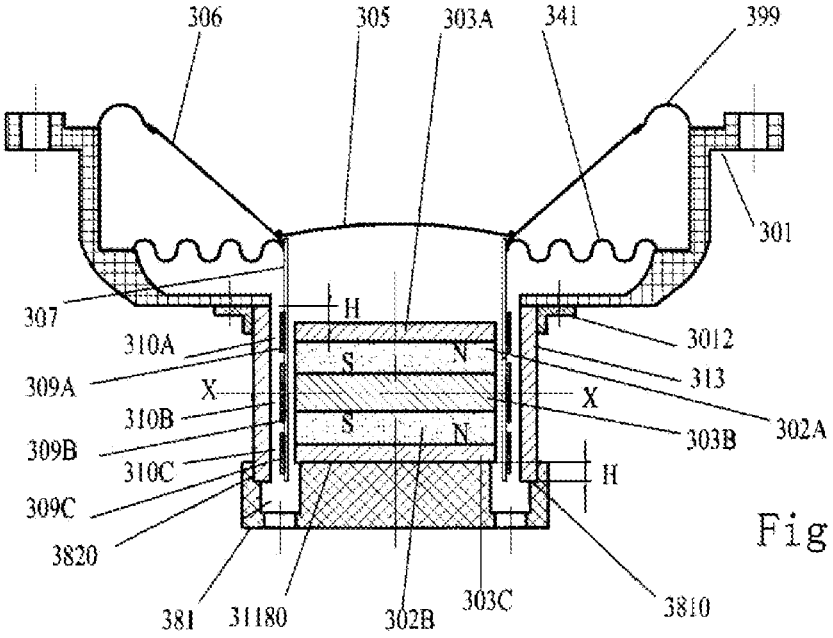
FIG. 7: Longitudinal diagram of the embodiment of three-magnetic gaps and three-coil inner-magnet speaker.

FIG. 7 shows longitudinal diagram of the embodiment of three-magnetic gap and three-coil inner-magnet speaker of the present invention The NdFeB magnet 302A and 302B of axial magnetization are bound on the plane separately on both sides of an circular polar plate 302B, and circular polar plates 303A and 303C are bound on the external face of magnet 302A and 302B. Polarity of two magnets (N and S pole) is as shown in FIG. 7, three polar plates are provided with the same projected area and match with two magnets, and thicknesses of element 303C and 303A are equal. The thickness of element 303B is large enough comparing with the thickness of element 303A to ensure that magnetic line of force passing through it without causing saturation, thus consist of a pair of repulsion type magnet and magnetic core coaxially mounted. The magnetic core is put on concave circular platform face 31180 of aluminum alloy support 381 that is coated with cloth adhesive in advance, and essential frock guarantees the magnetic core and ring-shaped magnet yoke 313 is mounted coaxial on axis part of element 31180. Meanwhile, two top and down end faces of element 113 have the same H value (0-8 mm) as lateral polar plane of element 303A and 303C, internal flank of element 313 and vertical flank of element 303A, 303B and 303C consist of three coaxial magnetic gap 310A, 310B and 310C with same diameter. A plastic flange plate 3012 is bound and fixed on the top part of element 313, and both of them are provided with the same installation plane. The lower part of element 313 is embedded into the horizontal locating face 3810 and vertical locating 3820 of aluminum alloy support 381 as well as bound and fixed with binder. After frock is removed, coil skeleton 307 and three coils 309A, 309B and 309C are embedded into the ring-shaped magnetic gap. These three coils are wound by one or two layer of magnetic wire. For example, seen from diaphragm 306 direction, coil 309A and 309C is set as clockwise winding direction, and coil 309B is counter clockwise winding direction (vice versa). The tail end YA of element 309A and head end XB of element 309 B are connected in series, tail end YB of element 309B and head end XC of element 309 C are connected in series and tail end YC of element 309 C is led up vertically along element 307 and consist of a pair of signal input terminal of the speaker with head end XA of element 309C. It is regulated that cross-sectional area of electromagnetic wire and winding tension of coil 309 A, 309 B and 309 C are equal to each other; number of coil turn, coil winding depth, coil resistance, absolute value of coil inductance of element 309 A is equal to that of element 309C; number of coil turn, coil winding depth, coil resistance, absolute value of coil inductance of element 309B is equal to summary for number of coil turn, coil winding depth, coil resistance, absolute value of coil inductance element 309A and 309C, thus consisting of two groups of symmetrical magnetic circuit and symmetrical coil circuit that take central axis of repulsion type magnet as vertical symmetrical axis and bisector axis of ½ of axial height of element 303B. Refer to the present invention FIGS. 13A and 13B, or 14A and 14B for wiring diagram of circuit principle for magnetic structure and three coils (Refer to relevant patent documents of WO 99/31931 patent family proposed by the inventor for details which are not described again hereby).

Then elastic wave 341, coil skeleton 307, diaphragm 306, dangling edge 399, dust cap 305 and frame 301 are bound and fixed together. Thus, inductance as well as counter electromotive force obtained during reciprocating type motion course of three coils 309A, 309B and 309 C for the embodiment of the present invention offset each other due to 180 degree phase angle. The speaker described by the embodiment is a multi magnetic gaps and multi coils speaker that is featured with resistor load or similar resistor load and with high sensitivity and hi-fi quality.

Figure 8:
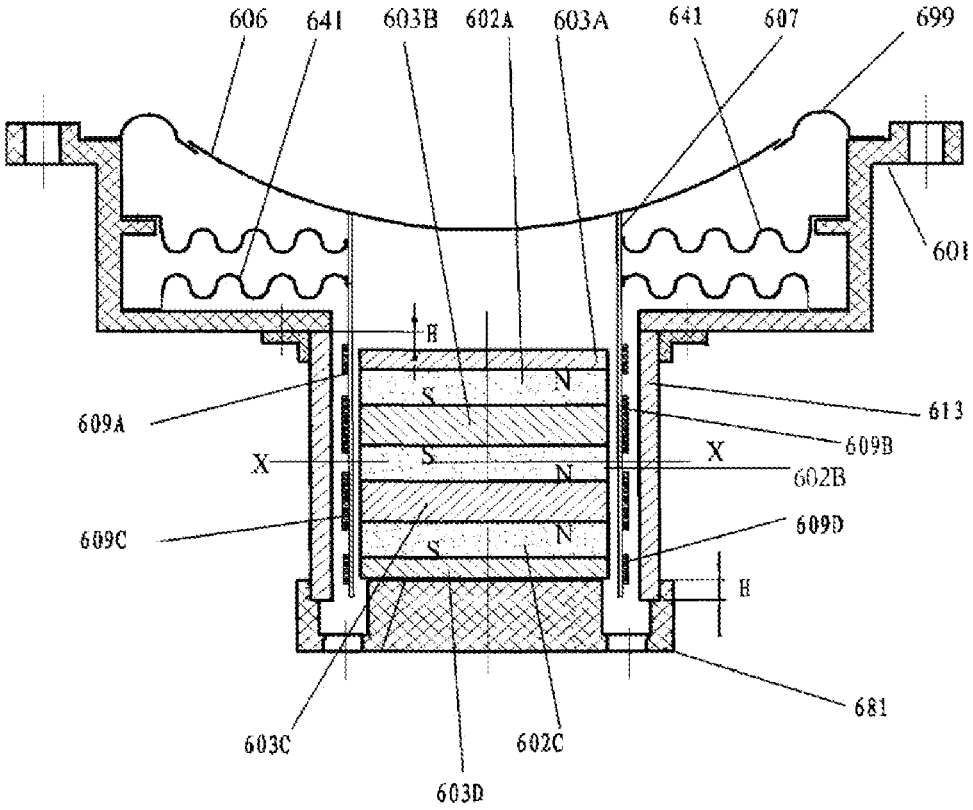
FIG. 8: Longitudinal diagram of the embodiment of four-magnetic gaps and four-coil inner-magnet speaker.

FIG. 8 shows longitudinal diagram of the embodiment of four-magnetic gap and four-coil inner-magnet speaker of the present invention The frame is a frame 601 made of aluminum alloy with two circular axis hole at least equipped with at its axis part. The circular platform face of 2 elastic wave 641 is provided with at different axial height of frame 601. The NdFeB magnet 602A and 602B which are filled with magnetic in axial direction are bound separately on the plane on both sides of polar plate 603B, the magnets are provided with the same S polarity at one side close to polar plate 603B, and polar plate 603A and 603C are bound separately on external polar planes of two magnetic 602A and 602B. The NdFeB magnet 602C is bound on the external side of polar plate 603C. The polar plate 603D is bound on the external side of element 602C, thus consisting of above two pairs of repulsion type magnets (refer to FIG. 7 for their polarity). 4 polar plates axially mounted are provided with the same projection area and match with 3 NdFeB magnets to consist of the magnetic circuit and magnetic core. Refer to the embodiment of the present invention for contents such as a support 681 made of aluminum alloy, and a ring-shaped magnet yoke 613 of magnetic core coaxially mounted, as well as structure and installation of frame 601, elastic wave 641, diaphragm 606, and dangling edge 699, and symmetrical magnetic circuit of magnetic gap consisting of external polar plane of polar plate 603A and 603D and two end faces of ring-shaped magnet yoke.

The internal flank of the ring-shaped magnet yoke 613 and vertical flank of the four polar plates consist of four coaxial ring-shaped magnetic gaps with same diameter, thus coil skeleton 607 and four coils coaxially mounted are inserted, and the coils are made by winding one or two layers of magnetic wire.

Seen from the outboard of diaphragm, two coils 609A and 609D at the lateral side are provided with clockwise winding direction and counter clockwise winding direction, and the coils 609B and 609C in the middle must be correspondingly provided with counter clockwise winding direction and clockwise winding direction, vice versa. Tail end YA of element 609A and head end XB of coil 609B are connected in series, Tail end YB of coil 609 B and head end XC of coil 609 C are connected in series, tail end YC of coil 609 D and head end XD of coil 609 D are connected in series, and tail end YD of coil 609 D is led up vertically along coil skeleton 607 and consist of a pair of signal input terminal of the speaker with head end XA of coil 609 A. It is regulated that cross-sectional area of magnetic wire, number of coil turn, coil winding depth, coil resistance, absolute value of coil inductance, and winding tension of 4 coils 609A and 609D/609B and 609C are equal to each other, thus consisting of two groups of symmetrical coil circuit from top to bottom that takes bisector X-X axis of ½ of axial height of magnet 602B as horizontal and symmetrical axis. The inductance and counter electromotive force obtained during reciprocating type motion course of four coils offset each other due to 180 degree phase angle. The speaker is a multi magnetic gaps, multi coils inner-magnet speaker that is featured with resistor load or similar resistor load as well as with high sensitivity and hi-fi quality.

FIG. 13 shows wiring diagram (I) of coil circuit principle of three-magnetic gap and three-coil speaker, FIG. 14 shows wiring diagram (II) of coil circuit principle of three-magnetic gap and three-coil speaker, and FIG. 15 shows wiring diagram of coil circuit principle of four-magnetic gap and four-coil speaker. Refer to corresponding figures and instruction of CN200820092177.9 patent application document for related instruction of operation principles which are not described again hereby. Undoubtedly, according to the content described in the embodiment of the present invention, it is very easy for common technicians to implement multi magnetic gaps and multi coils inner-magnet speaker of above four-magnetic gap and above four coils by way of increasing polar plate and number of magnet.

As for wiring diagram of circuit principle for speaker of above four-magnetic gap and above four coils, the simplest way is to parallel all coils together by two pieces of copper coils set vertically, which is as described in CN24370927 patent by the inventor. At this time equivalent impedance and counter electromotive force will become negligible.

Figure 9:
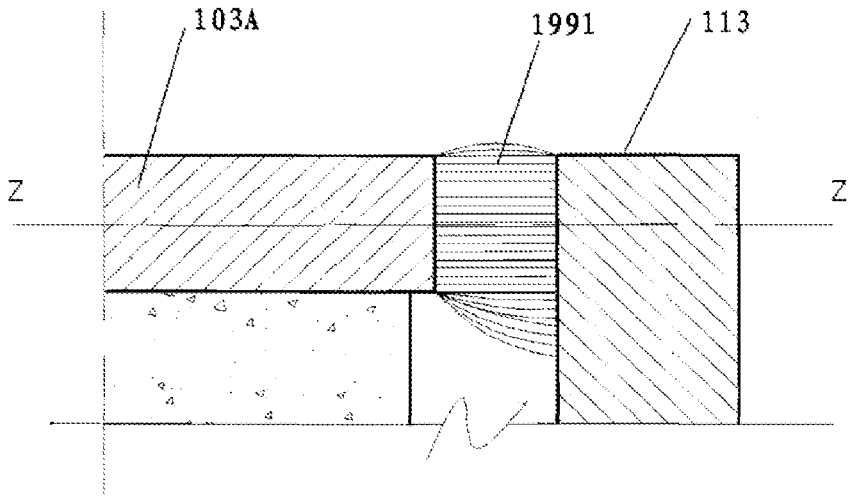
FIG. 9: Schematic diagram of magnetic gap and magnetic line of force distribution of lateral polar plate of prior art.

FIG. 9 shows schematic diagram of magnetic gap and magnetic line of force distribution of lateral polar plate of prior art.

FIG. 9 is actually a schematic diagram of amplification for one node of the embodiment in FIG. 6 of the present invention. Element 103A is a outboard polar plate of the speaker of which level bisector of ½ axial height is Z-Z axis. As shown in FIG. 9, at this time outboard polar face 103A of the polar plate and end face of ring-shaped magnet yoke 113 are flat, which is equal to H=0 shown in FIG. 6. The magnetic line 1991 of force of permanent magnetism in ring-shaped magnetic gap represents asymmetric status on both sides of Z-Z axis. If coil 109A shown in FIG. 6 is inserted into the magnetic gap, bisector of ½ axial height of the coil will overlap with Z-Z axis. When audio current passes through the coil 109A, magnetic line of force of permanent magnetism at the top and bottom part of Z-Z axis is different in distribution form and density, thus different electromotive forces F are produced at the top and bottom of Z-Z axis of coil 109A, deforming the coil and increasing distortion of the speaker.

FIG. 10 shows schematic diagram of magnetic gap and magnetic line of force distribution of outboard pole plate of the present invention.

At this time H>0, H value is closely related with caliber of speaker, geometric dimensioning of magnetic and magnetic energy product. It can be seen from FIG. 10 that magnetic line 1991 of force of permanent magnetism always represent symmetrical status on both sides of Z-Z axis, and defect of prior art shown in FIG. 9 is corrected.

FIG. 11 shows the working principle diagram of EMF offset in symmetric magnetic circuit and symmetric coil circuit of the present invention.

FIG. 11-A represents the waveform of inputting a sine wave audio current signal into the coil (such as the element 109A shown in FIG. 6) on one side of X-X axis of the speaker and the counter electromotive force spike pulse waveform sensed when pasting the zero point in the embodiments of the present invention. FIG. 11B represents the waveform of inputting a sine wave audio frequency current signal into the coil (such as the element 109B shown in FIG. 6) on the other side of the speaker axis and the counter electromotive force spike pulse waveform sensed when pasting the zero point in the embodiments of the present invention. With reference to the above two figures, the sine wave audio current signals in the two symmetrical coils have a phase angle of 180 degrees, in accordance with the regulation of implement the present invention. FIG. 11C represents the counter electromotive force spike pulse waveform sensed in the coil (such as the element 109A shown in FIG. 6) on one side of X-X axis of the speaker in the embodiments of the present invention. FIG. 11D represents the counter electromotive force spike pulse waveform sensed in the coil (such as the element 109B shown in FIG. 6) on the other side of X-X axis of the speaker in the embodiments of the present invention. As winding directions of the two coils on the two sides of the X-X axis are reverse, the counter electromotive forces sensed in the two coils have a phase angle of 180 degrees, so as balance out to zero or nearly zero.

To better illustrate the problems on counter electromotive force, FIG. 20 represents the schematic diagram of working principle of the audio current and counter electromotive force of single magnetic gap and single coil speaker of prior art. Element 1 is an audio signal source, element 2 is a traditional single magnetic gap and single coil speaker, element 2' is an equivalent generator potential of the single magnetic gap and single coil speaker, namely the counter electromotive force signal source, and element 3 is an equivalent load during operation of the speaker generator status. With reference to the lower part of FIG. 20: when the single magnetic gap and single coil speaker is connected with the audio signal source, a instantaneous audio current I flows through the speaker, and the speaker generates a corresponding electromotive force F, with the directions shown in the figure. At this time, with reference to the upper part of FIG. 20: as the coil of the single magnetic gap and single coil speaker performs reciprocating motion under the electromotive force F and cuts the magnetic line of force of the permanent magnet vertically to become a generator 2'. Its equivalent load is element 3. Potential of the generator, namely flow direction of the counter electromotive force, is shown as E and has a phase angle of 180 degrees with the audio current in the coil (ignoring parasitic capacitance and affect of the inductance), causing distortion of the audio current after superposition.

FIG. 21 represents the working principle diagram of audio current and EMF of speaker with multi magnetic gaps and coils in symmetric magnetic circuit and symmetric coil circuit of the present invention. With reference to the lower part of FIG. 21: when the said speaker is connected with the audio signal source 21, a instantaneous audio current I flows through the reversely winded symmetrical coil 23A and 23B of the speaker, the two reversely winded symmetrical coils generate two corresponding electromotive forces FA and FB which have the same direction and form a resultant force F. With reference to upper part of FIG. 21: as the two symmetrical coils of the multi magnetic gaps and multi coils speaker perform reciprocating motion under the electromotive force F and cuts the magnetic line of force of the permanent magnet vertically to comprise two equivalent generators 23A' and 23B'. As the two coils are reversely winded and have the characteristics of symmetrical magnetic circuit and symmetrical coil circuit, absolute values of generator potentials of the two coils are equal and have a phase angle of 180 degrees. The counter electromotive force EA and EB are balanced out or nearly balanced out when flowing through the equivalent load 24.

Figure 18:
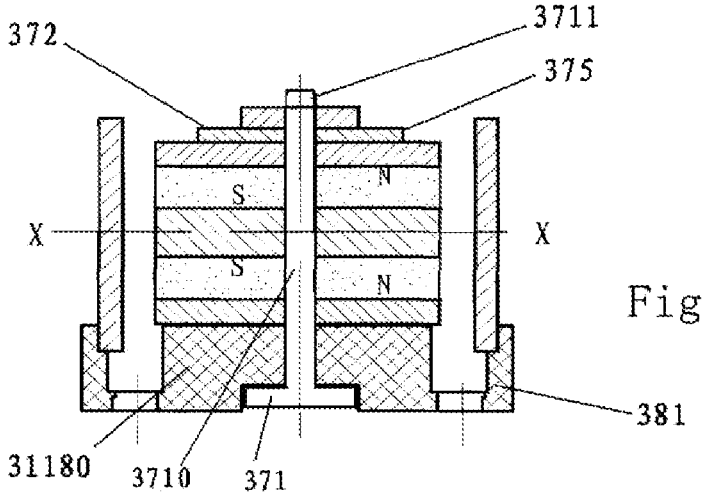
FIG. 18: Installation diagram of support and magnetic core of three-magnetic gap and three-coil inner-magnet speaker.

FIG. 18 represents installation diagram of support and magnetic core of three magnetic gaps and three coils inner-magnet speaker of the present invention.

Figure 19:
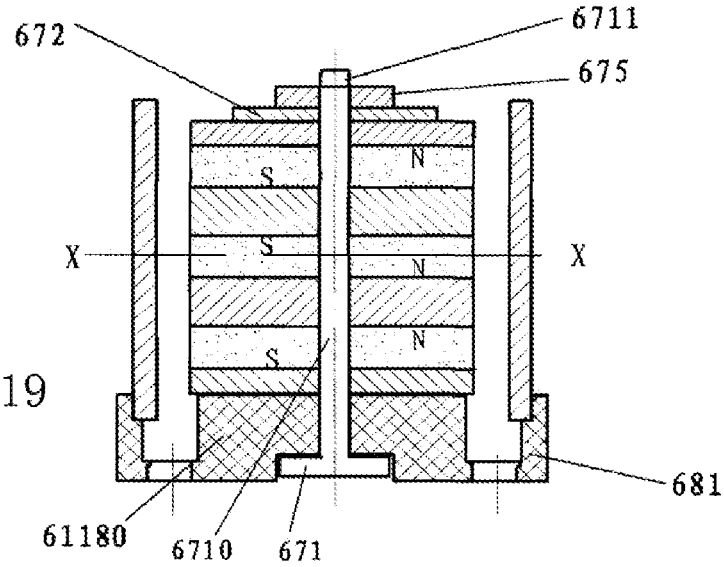
FIG. 19: Installation diagram of support and magnetic core of four-magnetic gap and four-coil inner-magnet speaker.

FIG. 19 represents installation diagram of support and magnetic core of four-magnetic gap and four-coil inner-magnet speaker of the present invention.

This is the magnetic circuit installation drawing separated from FIG. 7 and FIG. 8.

As it will be appreciated from what has been described above: the present invention provides an inner-magnet speaker technology scheme with three-magnetic gap and three-coil, four-magnetic gap and four-coil, and even more magnetic gaps and more coils. In these speaker technology schemes, the magnets mounted on two sides of a circular plate have the same polarity, so as to comprise at least a pair or more pairs of repellent magnet and magnetic core of the said magnetic circuit. When these magnets are of large geometric size and high magnetic energy product, the axial thrust between the repellent magnets becomes great, not only increasing the difficulty in binding and fixing of magnetic cores but also causing new unstable factors to reliable operation of the speaker. FIG. 18 and FIG. 19 represent a new technology scheme: central axis holes with the same projected area are positioned on the plate and the axis center of the magnet, the axis center of the said support 381 or 681 made of nonmagnetic materials of the said speaker also has a central axis hole with the same projected area or a screw hole matching with it. A fastener 3710 or 6710 made of nonmagnetic material, such as fastener made of 1Cr18Ni_9Ti stainless steel, goes through the axis hole and applies sufficient static pressure to the plate and the magnet with a pressure plate 372 or 672 matching with the plate and made of nonmagnetic material and binds and fixes them to the convex platform 31180 or 61180 of support in the speaker.

FIG. 18 and FIG. 19 represent the static pressure applied to the said magnetic core by the set torque of screw 3711 or 6711 and nut 375 or 675. Based on technologies known to the public: as long as the fastener 3710 or 6710 as shown in the Fig. is revolved by 180 degrees and the said central axis hole of support 381 or 681 is changed to the screw hole matching with the screw, a static pressure is applied to the plate 372 or 672 through adjusting torque of nut 371 or 671. The magnetic core can also be bonded and fixed to the convex platform 31180 or 61180 of the support 381 or 681 with the fastener 3710 or 6710. Based on technologies known to the public: if the nonmagnetic stainless steel fastener 3710 or 6710 is replaced by an aluminum rivet with semicircle head, tail of the said rivet can be riveted to plate 372 or 672 by applying a proper pressure, the magnetic core can also be bonded and fixed to the platform 31180 or 61180 of the support 381 or 681 of the speaker.

FIG. 16 represents the embodiment diagram of 2.0 channel multimedia sound system of the present invention.

FIG. 16-A represents front view of the left speaker of a 2.0 channel USB audio system. A dual-magnetic gaps and dual-coil speaker 1 with caliber of 3 inches is equipped in the speaker. The speaker has the symmetrical magnetic circuit and symmetrical coil circuit and has only one cone-shaped diaphragm 8, and diameter of middle hole of the cone top is less than 26 mm Speaker 2 is a pair of wooden shelf-type enclosed box. An aluminum support 3 is connected and fixed with body of the box through a fastener. The connection between bottom of the speaker 2 and top of the support 3 has a sealed hole for the audio connection wire of the speaker to go through. A USB Mini interface socket 4 is equipped at the neck of front of the support 3. A 3.5 mm audio current output socket 6 is mounted at the neck of back of the support 3, as shown in FIG. 16-C. A piece of PCB plate 7 is mounted at the neck of aluminum alloy support of the left speaker. A group of USB DAC described in the present invention and a group of dual-channel D type audio frequency amplifier IC chips are equipped over it. The attached SMD mounted electronic elements, and appendix circuit: overload heat protection circuit, and short-circuit protection circuit, etc., are integrated in the same IC chip. The maximum continuous output power of the audio amplifier in this embodiment under the rated voltage is less than or equal to 2×1 W. FIG. 16-B represents rear view of the right speaker of a 2.0 channel USB audio system. The body of its speaker is completely the same as the left speaker. This speaker also has an aluminum support 3, a 3.5 mm audio frequency current input socket 6 is mounted at back of neck of the support. The above mentioned left and right speakers are connected into a pair of 2.0 channel USB audio digital interface multimedia sound system with a audio connection cable.

According to this embodiment, the left and right speakers are enclosed boxes with the same volume. The speaker 1 with caliber of 3 inches is a coaxial single-point full frequency band speaker, even using DAC with 16 Bit conversion precision, sound of this pair of speaker is loud, with precise sound image positioning, fine and vivid sound quality, sweet and full sound, incisive and vivid detailed performance, obvious higher resolution than traditional multimedia speaker, and with the frequency response of 80 Hz to 20 KHz.

FIG. 17 represents the embodiment diagram of 2.1 channel multimedia sound system of the present invention.

FIG. 17-A represents the front view of the left and right channel speakers. Each speaker is equipped with dual-magnetic gaps and dual-coil speaker 1 with caliber of 4 inches. The speaker has symmetrical magnetic circuit and symmetrical coil circuit and has only one cone diaphragm 4, and diameter of middle hole of the cone top is less than 26 mm. A speaker 2 is a pair of wooden shelf-type equivalent volume unenclosed box. FIG. 17-B represents rear views of the left and right channel speakers. A 3.5 mm audio current input socket 7, inverter tube air outlet 8, and crash pad 10 are equipped on the junction box 11. FIG. 17-C represents front view of the heavy bass speaker. A USB input interface 39, a LED signal light 36, a mute button 35, a volume control buttons 34 and 33, and an inverter tube air outlet 38, and two 3.5 mm audio frequency current input sockets 37 are equipped on panel 30. A piece of PCB plate is equipped inside the heavy bass speaker and is equipped with a group of DACs, a group of 2.0 channel D type audio power amplifiers, a group of electronic frequency dividers with pass band of 40 Hz to 150 Hz, a group of heavy bass D type audio power amplifiers, and matching filtering energy storage electrolytic capacitance which are not more than 100000 μF, necessary control circuit, overload heat protection circuit, short-circuit protection circuit, and SMD surface mounted electronic elements, etc. FIG. 17-D represents side view of the heavy bass speaker. A heavy bass speaker with caliber of 6.5 inches is equipped on the panel 32 and it is a three-magnetic gap and three-coil or four-magnetic gap and four-coil band pass heavy bass speaker with pass band of 40 Hz to 150 Hz and with the symmetrical magnetic circuit and symmetrical coil circuit, and resistive load characteristic or similar resistive load characteristic and has only one cone-shaped diaphragm. The diameter of middle hole of the cone top is less than 33 mm. There is a another USB input interface providing DC 5V independent power for the heavy bass speaker on back of the heavy bass speaker, but it is omitted in this figure.

The present invention has the advantages of:

1. Driving a pair of single-diaphragm full frequency band speaker with caliber of less than 7 inches to comprise a 2.0 channel energy saving digital multimedia sound system only with the 2×1 W or 2×2 W audio output power provided by a PC USB interface.
2. Driving a pair of single-diaphragm full frequency band speaker with caliber of less than 7 inches and a single-diaphragm heavy bass speaker with caliber of less than 7 inches to comprise a 2.1 channel energy saving digital multimedia sound system only with the (2×1) W+(1×2) W or (2×2) W+(1×4) W audio frequency output power provided by the PC USB interface.
3. Breaking through the technical roadblock of counter electromotive force of speaker restricting the efficiency improvement of speaker, having puzzled the field of electrical sound in the world for more than 130 years.
4. In the 2.0 channel and 2.1 channel digital multimedia sound systems, the traditional power transformer, high pitch speaker, frequency divider, and aluminum radiator of the power amplifier being eliminated, so as to save a plurality of precious social resources.
5. Providing the simplest and safest multimedia sound operation and using scheme for computer consumers.
6. Implementing remote real-time monitoring to computers through local area network and Internet.
7. The present invention obtains unforeseeable technical effects. With the composite invention using existing patent technology of this inventor and its improved technology scheme, the traditional 2.0 and 2.1 channel active multimedia sound systems of computer are changed into passive digital multimedia sound system. According to conservative estimation, each computer can save 20 W power in average, so as to making outstanding contribution to the computer environmental protection energy saving cause of 1 billion computers in the world.

The last to be mentioned is that different types of outer-magnet and inner-magnet full frequency band speaker and corresponding multimedia sound systems can be combined with all the magnetic circuit structures and different connection manners of speaker coil circuits shown from FIG. 1 to FIG. 21 of the present invention and those proposed by patent family A, B, and C. Although the present invention cannot introduce these embodiments one by one, in despite of the combination and even partial modification of the above technical characteristics of the present invention, the general technology scheme and core invention content cannot surpass the coverage proposed in the claims and descriptions of the present invention.

What is claimed is:

1. A multimedia sound system with digital audio interface, comprising:

a computer or a game console having one or more interfaces comprising at least one of a Universal Serial Bus (USB) interface, an Institute of Electrical and Electronics Engineers 1394 (IEEE1394) interface, a coaxial cable interface, or a fiber-optic interface;

one or more 2.0 channel external sound cards to connect the one or more interfaces with one or more corresponding D type or T type Integrated Circuit chips (IC chips) of an audio frequency power amplifier;

a pair of channel speakers comprising a left channel speaker and a right channel speaker;

one or more control and protection circuits to protect the one or more 2.0 channel external sound cards, the audio frequency power amplifier, the one or more IC chips, and/or the pair of channel speakers, wherein:

the one or more 2.0 channel external sound cards, the one or more IC chips, one or more elements of a Surface Mount Device circuit (SMD circuit) that is coupled to the one or more IC chips, one or more elements of an integrated Complementary Metal Oxide Semiconductor circuit ("CMOS circuit") that is integrated with the one or more IC chips, a Light Emitting Diode (LED) signal light to indicate working conditions of the one or more external sound cards, and/or a volume control device of the audio power amplifier are mounted on a Printed Circuit Block (PCB) or connected to the PCB through wires and connectors;

the PCB board is positioned inside the left channel speaker or on at least one support of the pair of channel speakers;

the LED signal light and the volume control device are fastened to a speaker panel of the left channel speaker or on at least one support of the pair of channel speakers;

the PCB board or a speaker panel of the left channel speaker includes a power socket that matches the one or more interfaces and connects to the computer or the game console through at least one of: a plug of an extension cable of the one or more interfaces or directly to the one or more interfaces of the computer or the game console;

a panel of the right channel speaker is mounted with an audio frequency power socket;

an audio frequency cable connects the left channel speaker and the right channel speaker to form a 2.0 channel sound system;

each of the one or more 2.0 channel external sound cards has at least one stereo Digital to Analog Converter (DAC) of simplex 16 to approximately 48 bits;

the at least one DAC and the one or more IC chips are powered by a 5 V power supply from the one or more interfaces, and each of the at least one DAC and the one or more IC chips has a set of filtering and energy storage electrolytic capacitors that are connected in parallel and located closest to each of the respective input pins of the at least one DAC and the one or more IC chips;

a specified lower limit of a rated working voltage of the audio power amplifier is 1.1 V to approximately 2.7 V lower than a specified lower limit of a rated working voltage of the at least one DAC so that transient working voltages of the audio power amplifier and the at least one DAC do not exceed the lower limit of the rated working voltage of the audio power amplifier when 2.0 channel sound system outputs a large dynamic low audio signal of sufficiently large width;

the specified rated working voltage of the audio power amplifier is less than or equal to 5.2 VDC or DC 8-15V, and the rated continuous power of each channel of the audio power amplifier is less than or equal to 2 W;

at least one of the left channel speaker or the right channel speaker comprises at least one multi magnetic gap and at least one multi coil that each have one or more resistor loads;

the left channel speaker and/or the right channel speaker that has the at least one multi magnetic gap and the at least one multi coil is equipped with a cone-shaped or concave diaphragm that has a caliber that is less than or equal to 7 inches; and the diaphragm of the left channel speaker and/or the right channel speaker that has the at least one multi magnetic gap and the at least one multi coil has a central hole with the diameter of 26 mm to 33 mm such that the left channel speaker and/or the right channel speaker that has the at least one multi magnetic gap and the at least one multi coil is a full frequency band speaker having two single-point coaxial sound production, wherein an inductance generated by the multi magnetic gaps and the multi coils is offset by a phase angle of 180 degrees due to a counter electromotive force that results from a reciprocating motion.

2. The multimedia sound system of claim 1, wherein:

the at least one multi magnetic gap is a dual-magnetic gap and the at least one multi coil is a dual-coil;

the left channel speaker or the right channel speaker that has the dual-magnetic gap and the dual-coil has upper and lower polar plates that are mounted coaxially and positioned symmetrically;

each of the upper and lower polar plates is a circular panel with a central axis hole;

at least one of a round sheet magnet or a NdFeB that is magnetized and that has a polarization in a thickness direction is clamped between the upper polar plate and the lower polar plate, the magnet being matched to the upper and lower polar plates;

in terms of axial height, a ring-shaped magnetic yoke that is mounted coaxially with the upper and lower polar plates exceeds a lateral polar plane of each of the upper and lower polar plates by 0.5 to 8 mm so as to form two groups of magnetic gap circuits that are each characterized by a complete longitudinal symmetry;

an external peripheral face of the ring-shaped magnetic yoke and a vertical peripheral face of the upper and the lower polar plates constitute two coaxial ring-shaped magnetic gaps with equal diameter;

two coaxial coils of equal diameter are inserted into the ring-shaped magnetic gaps;

the two coaxial coils are made by winding one or two layers of magnetic wires;

a gap exists between the two coaxial coils;

a winding direction of the coils and a direction of current flowing through the coils are prescribed so that the two coils generate an electromotive force in a direction at a working instant;

wherein when a central axis of the upper and the lower polar plates is chosen as a vertical symmetry axis and if a bisector at one-half axial height of the magnet is chosen as a horizontal axis of symmetry, the left channel speaker or the right channel speaker that has the dual-magnetic gap and the dual-coil has a magnetic circuit marked by a bilateral and an up-down symmetry in terms of geometrical shape and magnetic property;

a cross section area, a number of turns, a coil winding depth, a coil resistance, an absolute value of an inductance of the coils, and a winding tension of each of the two coils is equal; and while the bisector at one-half axial height of the magnet is chosen as the horizontal axis of symmetry, the left channel speaker or the right channel speaker that has the dual-magnetic gap and the dual-coil has two sets of coil circuits that have longitudinal symmetry so that a full frequency band outer-magnet speaker of dual-magnetic gaps and a dual-coil or a band-pass bass speaker marked with resistive or load characteristics is formed.

3. The multimedia sound system of claim 1, wherein:

the at least one multi magnetic gap is a dual-magnetic gap and the at least one multi coil is a dual-coil;

the left channel speaker or the right channel speaker that has the dual-magnetic gap and the dual-coil has upper and lower polar plates that are mounted coaxially and positioned symmetrically;

the upper and lower polar plates are two circular panels;

at least one of a round sheet magnet or a NdFeB magnet that is magnetized and that has a polarization in a thickness direction is clamped between the upper polar plate and the lower polar plate, the magnet being matched to the upper and lower polar plates;

in terms of axial height, a ring-shaped magnetic yoke that is mounted coaxially with the upper and lower polar plates exceeds a lateral polar plane of each of the upper and lower polar plates by 0.5 to 8 mm so as to form two groups of magnetic gap circuits that are characterized by a complete longitudinal symmetry;

an internal peripheral face of the ring-shaped magnetic yoke and a vertical peripheral face of the upper and the lower polar plates constitute two coaxial ring-shaped magnetic gaps with equal diameter;

two coaxial coils having equal diameter are inserted into the ring-shaped magnetic gaps;

the coils are made by winding one or two layers of magnetic wires;

a gap exists between the two coaxial coils;

a winding direction of the coils and a direction of current flowing through the coils are prescribed so that the two coils generate an electromotive force in a direction at a working instant;

if a central axis of the upper and the lower polar plates is chosen as a vertical symmetry axis and if a bisector at one-half axial height of the magnet is chosen as a horizontal axis of symmetry, the left channel speaker or the right channel speaker that has the dual-magnetic gap and the dual-coil has a magnetic circuit marked by a bilateral and an up-down symmetry in terms of geometrical shape and magnetic property;

a cross section area, a number of turns, a coil winding depth, a coil resistance, an absolute value of an inductance of the coils, and a winding tension of each of the two coils is equal; and while the bisector at one-half axial height of the magnet is chosen as the horizontal axis of symmetry, the left channel speaker or the right channel speaker that has the dual-magnetic gap and the dual-coil has two sets of coil circuits that have longitudinal symmetry so that a full frequency band inner-magnet speaker of dual-magnetic gaps and dual-coil or a band-pass bass speaker is formed.

4. The multimedia sound system of claim 1, wherein:

the at least one multi magnetic gap is three magnetic gaps and the at least one multi coil is three coils each side of a circular plate made of magnetic material is mounted with a round sheet magnet and/or a NdFeB magnet that is used for magnetizing and that has a polarization in a thickness direction;

each of the magnets has a polarity on a side of the plate close to the magnet that is the same;

three circular plates made of magnetic material are mounted separately on a lateral face of each magnet to form a pair of repulsion magnets;

the three circular plates that are mounted on each magnet are mounted coaxially, have the same projected area and match a projected plane of the two coaxially mounted magnets;

in terms of axial height, a ring-shaped magnetic yoke that is mounted coaxially with a central axis of the circular plate that has each of its sides mounted with a round sheet magnet and/or a NdFeB magnet exceeds a lateral polar plane of each side of the circular plate that has each of its sides mounted with a round sheet magnet and/or a NdFeB magnet by 0.5 to 8 mm so as to form two groups of magnetic gap circuits that are characterized by a complete longitudinal symmetry;

an internal peripheral face of the ring-shaped magnetic yoke and a vertical peripheral face of the circular plate that has each of its sides mounted with a round sheet magnet and/or a NdFeB magnet constitute three coaxial ring-shaped magnetic gaps with equal diameter;

three coaxial coils of equal diameter that each have the same cross-sectional area are inserted into the ring-shaped magnetic gaps;

the coils are made by winding one or two layers of magnetic wires;

a winding direction of the coils and a direction of current flowing through the coils are prescribed so that the three coils generate an electromotive force in a direction at a working instant, if the central axis of the circular plate that has each its sides mounted with a round sheet magnet and/or a NdFeB magnet is chosen as a vertical symmetry axis and if a bisector at one-half axial height of the central plate is chosen as a horizontal axis of symmetry, the left channel speaker and/or the right channel speaker that has the three magnetic gaps and the three coils has a magnetic circuit that is marked by a bilateral and an up-down symmetry in terms of geometrical shape and magnetic property;

a coil resistance, a coil winding depth, an absolute value of an inductance of the coils, and a winding tension of each of the coils is equal; and while the bisector at the one-half axial height of the central plate is chosen as the horizontal axis of symmetry, the left channel speaker and/or the right channel speaker that has the three magnetic gaps and the three coils has two sets of coil circuits that have longitudinal symmetry so that a full frequency band inner-magnet speaker of three magnetic gaps and three coils or a band-pass bass speaker is formed.

5. The multimedia sound system of claim 4, wherein:

an axis position of the three plates of the inner-magnet speaker with three magnetic gaps and three coils, and an axis position of the two magnets are equipped with central axis holes of equal projected areas;

an axis position of one or more supports of the speaker is made from a non-magnetic material;

each of the one or more supports has a central axis hole of the same projected area or a matching screw hole;

a fastener made of non-magnetic material passes through the axis hole or the matching screw hole; and a pressure plate made of non-magnetic material that matches the plate exerts static pressure on the plate and the magnet so as to fasten them firmly at the one or more supports.

6. The multimedia sound system of claim 1, wherein:

the at least one multi magnetic gap is at least four magnetic gaps and the at least one multi coil is at least four coils;

each side of a circular plate of magnetic material is separately mounted with a round sheet magnet and/or a NdFeB magnet that is used for magnetizing and polarizing in a thickness direction;

each of the magnets has a polarity on a side of the plate close to the magnet that is the same;

at least four circular plates made of magnetic material are mounted separately on a lateral side of each magnet to form at least three pairs of repulsion magnets;

the at least four circular plates that are mounted on each magnet are mounted coaxially, have the same projected and match a projected plane of the at least three coaxially mounted magnets;

in terms of axial height, a ring-shaped magnetic yoke that is mounted coaxially with a central axis of the circular plate that has each of its sides mounted with a round sheet magnet and/or a NdFeB magnet exceeds a lateral polar plane of each side of the circular plate that has each of its sides mounted with a round sheet magnet and/or a NdFeB magnet by 0.5 to 8 mm so as to form two sets of magnetic gap circuits that are each characterized by a complete longitudinal symmetry;

an internal peripheral face of the ring-shaped magnetic yoke that is mounted coaxially with the repulsion magnets and a vertical peripheral face of the circular plate that has each of its sides mounted with a round sheet magnet and/or a NdFeB magnet constitute at least four coaxial ring-shaped magnetic gaps that each have the same equal diameter;

at least four coaxial coils having equal diameter and the same cross-sectional area are inserted into the ring-shaped magnetic gaps;

a winding direction of the coils and a direction of a current flowing through the coils are prescribed so that the coils generate electromotive force in a direction at a working instant;

if a central axis of the circular plate that has each of its sides mounted with a round sheet magnet and/or a NdFeB magnet is chosen as a vertical symmetry axis and if a bisector at one-half axial height of the central plate is chosen as a horizontal axis of symmetry, the left channel speaker and/or the right channel speaker that has the at least four magnetic gaps and the at least four coils has at least three magnetic circuits marked by a bilateral and an up-down symmetry in terms of geometrical shape and magnetic property;

when the left channel speaker and/or the right channel speaker that has the at least four magnetic gaps and the at least four coils is viewed in the lateral direction of the diaphragm, if at least half of the coils revolve in a clockwise direction, the remaining half of the coils revolve in an anticlockwise direction;

a tail end of a first coil of the at least four coils is connected in series with a head of a second coil of the at least four coils that is adjacent to the first coil of the at least four coils until all the coils of the at least four coils are connected series, wherein a tail end of a last coil of the at least four coils is connected in series with the head end of the first coil of the at least four coils to form a pair of signal input terminals of a transducer;

a cross-sectional area of each of the at least four coils is equal a winding number of each of the at least four coils is equal, a winding depth of each of the at least four coils is equal, an absolute value of a resistance of half of the at least four coils is equal to an absolute value of a resistance of the other half of the at least four coils, and an absolute value of an inductance of half of the at least four coils is to an absolute value of an inductance of the other half of the at least four coils;

a winding tension of each of the at least four coils is equal; and while a bisector at one-half axial height of the central magnet is chosen as a horizontal axis of symmetry, the left channel speaker and/or the right channel speaker that has the at least four magnetic gaps and the at least four coils has two sets of coil circuits that have longitudinal symmetry so that a full frequency band inner-magnet speaker of at least four magnetic gaps and at least four coils or a band-pass bass speaker is formed.

7. The multimedia sound system of claim 6, wherein:

an axis position of the at least four plates of the inner-magnet speaker with at least four magnetic gaps and at least four coils, and an axis position of the at least three magnets are equipped with central axis holes of equal projected areas;

an axis position of one or more supports of the speaker is made from a non-magnetic material;

each of the one or more supports has a central axis hole of the same projected area or a matching screw hole;

a fastener made of non-magnetic material passes through the axis hole or the matching screw hole; and a pressure plate made of non-magnetic material that matches the plate exerts static pressure on the plate and the magnet so as to fasten them firmly at the one or more supports.

8. A multimedia sound system with digital audio interfaces comprises:

a computer or game console having one or more interfaces comprising at least one of an Universal Serial Bus (USB) interface, an Institute of Electrical and Electronics Engineers 1394 (IEEE1394) interface, a coaxial cable interface, or a fiber-optic interface;

a pair of channel speakers comprising a left channel speaker and a right channel speaker;

a subwoofer;

one or more 2.1 channel external sound cards connected, by the one or more interfaces, with one or more corresponding D type or T type IC chips of a 2.1 channel audio power amplifier of the pair of channel speakers or a 2.1 channel audio amplifier of the subwoofer; and one or more matched control and protection circuits to protect the one or more 2.1 channel external sound cards, the audio power amplifier of the pair of channel speakers, the audio amplifier of the subwoofer, the one or more IC chips, the pair of channel speakers, and/or the subwoofer, wherein:

the one or more 2.1 channel external sound cards, the one or more IC chips, one or more elements of a Surface Mount Device circuit ("SMD circuit") that is coupled to the one or more IC chips, one or more elements of an integrated Complementary Metal Oxide Semiconductor circuit ("CMOS circuit") that is integrated with the one or more IC chips, a LED signal light to indicate working conditions of the one or more external sound cards, a volume control device of the audio power amplifier, and/or a volume control of the heavy bass audio amplifier are mounted on a PCB board;

the PCB, the LED signal light, and the volume control devices are mounted in the subwoofer or on a panel of the subwoofer where a socket matching the one or more interfaces is mounted;

the one or more interfaces are connected to the computer or the game console via a plug of an interface extension cable;

each of a panel of the left channel speaker and a panel of the right channel speaker includes an audio jack;

each of the left channel speaker and the right channel speaker is connected to the subwoofer via an audio cable so as to make a 2.1 channel sound system;

each of the one or more 2.1 channel external sound cards has one or more 2.1 channel Digital to Analog ("DAC") decoders of simplex 16 to 48 bits, one or more signals of the pair of channel speakers are connected to the one or more IC chips of the audio power amplifier of the pair of channel speakers via the one or more DAC decoders, one or more analog signals of the subwoofer are connected to the audio amplifier of the subwoofer via an electrical crossover with a band-pass width of 20 Hz to 250 Hz;

if the computer is a PC, the one or more DAC decoders and the audio power amplifiers of the pair of channel speakers are powered by 5 V power supply from a first USB interface of the one or more USB interfaces of the computer, while the subwoofer is powered by a 5 V power supply from a second USB interface of the one or more USB interfaces of the computer;

if the computer is a MAC, the one or more DAC decoders, the audio power amplifier of the pair of speakers, the electrical crossover, and the subwoofer are powered by the same IEEE1394 interface of the one or more interfaces with a DC 8-15 V;

each of the one or more DAC decoders and the one or more IC chips of the audio power amplifier of the pair of speakers is connected in parallel to one or more filtering and energy storage electrolytic capacitors at locations closest to the respective input pins of each of the one or more DAC decoders and the one or more IC chips;

a specified lower limit of a rated working voltage of the audio power amplifier of the pair of channel speakers is 1.1 V to 2.7 V lower than a specified lower limit of a rated working voltage of each of the one or more DAC decoders so that transient working voltages of the audio power amplifier of the pair of channel speakers and the one or more DAC decoders do not exceed the lower limit of the rated working voltage of the audio power amplifier when the 2.1 channel sound system outputs a large dynamic low audio signal of sufficiently large width;

the rated working voltage of the audio power amplifier is less than or equal to 5.25 VDC or DC 8-15V;

a rated continuous output power of each of the left channel speaker and the right channel speaker is less than or equal to 2 W;

a specified rated continuous output power of the audio amplifier of the subwoofer is less than or equal to 4 W;

the one or more IC chips of the subwoofer are connected in parallel to one or more filtering and energy storage electrolytic capacitors that are less than or equal to 1,000 μF to 100,000 μF at locations closest to the power input pins of the one or more IC chips of the subwoofer;

at least one of the left channel speaker or the right channel speaker has at least one multi magnetic gap and at least one multi coil that each have one or more resistor loads;

the left channel speaker or the right channel speaker that has the at least one multi magnetic gap and the at least one multi coil is equipped with a cone-shaped or concave diaphragm that has a caliber that is less than or equal to 7 inches;

the diaphragm of the left channel speaker or the right channel speaker that has the at least one multi magnetic gap and the at least one multi coil has a central hole with the diameter of 26 mm to 33 mm such that the left channel speaker or the right channel speaker that has the at least one multi magnetic gap and the at least one multi coil is a full frequency band speaker having two single-point coaxial sound production and a counter electromotive force that results from a reciprocating motion that is offset due to a phase angle of 180 degrees;

the subwoofer has at least one multi magnetic gap and at least one multi coil that each have one or more resistor loads;

the subwoofer having the at least one multi magnetic gap and the at least one multi coil is equipped with a cone-shaped or concave diaphragm with a caliber that is less than or equal to 7 inches; and the diaphragm of the subwoofer having the at least one multi magnetic gap and the at least one multi coil has a central hole with the diameter of 26 mm to 33 mm such that the subwoofer that has the at least one multi magnetic gap and the at least one multi coil is a full frequency band speaker having two single-point coaxial sound production, wherein an inductance generated by the multi magnetic gaps and the multi coils is offset by a phase angle of 180 degrees due to a counter electromotive force that results from a reciprocating motion, such that a 2.1 channel digital multimedia sound system with ultra-high sensitivity and hi-fi quality and powered by the USB or the IEEE 1394 interfaces, has been formed.

9. The multimedia sound system of claim 8, wherein:

the at least one multi magnetic gap is a dual-magnetic gap and the at least one multi coil is a dual-coil;

the left channel speaker or the right channel speaker that has the dual-magnetic gap and the dual-coil has upper and lower polar plates that are mounted coaxially and positioned symmetrically;

each of the upper and lower polar plates is a circular panel with a central axis hole;

at least one of a round sheet magnet or a NdFeB magnet that is magnetized and that has a polarization in a thickness direction is clamped between the upper polar plate and the lower polar plate, the magnet being matched to the upper and lower polar plates;

in terms of axial height, a ring-shaped magnetic yoke that is mounted coaxially with the upper and lower polar plates exceeds a lateral polar plane of each of the upper and lower polar plates by 0.5 to 8 mm so as to form two groups of magnetic gap circuits that are each characterized by a complete longitudinal symmetry;

an external peripheral face of the ring-shaped magnetic yoke and a vertical peripheral face of the upper and the lower polar plates constitute two coaxial ring-shaped magnetic gaps with equal diameter;

two coaxial coils of equal diameter are inserted into the ring-shaped magnetic gaps;

the two coaxial coils are made by winding one or two layers of magnetic wires;

a gap exists between the two coaxial coils;

a winding direction of the coils and a direction of current flowing through the coils are prescribed so that the two coils generate an electromotive force in a direction at a working instant;

wherein when a central axis of the upper and the lower polar plates is chosen as a vertical symmetry axis and if a bisector at one-half axial height of the magnet is chosen as a horizontal axis of symmetry, the left channel speaker and/or the right channel speaker that has the dual-magnetic gap and the dual-coil has a magnetic circuit marked by a bilateral and an up-down symmetry in terms of geometrical shape and magnetic property;

a cross section area, a number of turns, a coil winding depth, a coil resistance, an absolute value of an inductance of the coils, and a winding tension of each of the two coils is equal; and while the bisector at one-half axial height of the magnet is chosen as the horizontal axis of symmetry, the left channel speaker or the right channel speaker that has the dual-magnetic gap and the dual-coil has two sets of coil circuits that have longitudinal symmetry so that a full frequency band outer-magnet speaker of dual-magnetic gaps and a dual-coil or a band-pass bass speaker marked with resistive or load characteristics is formed.

10. The multimedia sound system of claim 8, wherein:

the at least one multi magnetic gap is a dual-magnetic gap and the at least one multi coil is a dual-coil;

the left channel speaker or the right channel speaker that has the dual-magnetic gap and the dual-coil has upper and lower polar plates that are mounted coaxially and positioned symmetrically;

the upper and lower polar plates are two circular panels;

at least one of a round sheet magnet or a NdFeB magnet that is magnetized and that has a polarization in a thickness direction is clamped between the upper polar plate and the lower polar plate, the magnet being matched to the upper and lower polar plates;

in terms of axial height, a ring-shaped magnetic yoke that is mounted coaxially with the upper and lower polar plates exceeds a lateral polar plane of each of the upper and lower polar plates by 0.5 to 8 mm so as to form two groups of magnetic gap circuits that are characterized by a complete longitudinal symmetry;

an internal peripheral face of the ring-shaped magnetic yoke and a vertical peripheral face of the upper and the lower polar plates constitute two coaxial ring-shaped magnetic gaps with equal diameter;

two coaxial coils having equal diameter are inserted into the ring-shaped magnetic gaps;

the two coaxial coils are made by winding one or two layers of magnetic wires;

a gap exists between the two coaxial coils;

a winding direction of the coils and a direction of current flowing through the coils are prescribed so that the two coils generate an electromotive force in a direction at a working instant;

if a central axis of the upper and the lower polar plates is chosen as a vertical symmetry axis and if a bisector at one-half axial height of the magnet is chosen as a horizontal axis of symmetry, the left channel speaker or the right channel speaker that has the dual-magnetic gap and the dual-coil has a magnetic circuit marked by a bilateral and an up-down symmetry in terms of geometrical shape and magnetic property;

a cross section area, a number of turns, a coil winding depth, a coil resistance, an absolute value of an inductance of the coils, and a winding tension of each of the two coils is equal; and while the bisector at one-half axial height of the magnet is chosen as the horizontal axis of symmetry, the left channel speaker or the right channel speaker that has the dual-magnetic gap and the dual-coil has two sets of coil circuits that have longitudinal symmetry so that a full frequency band inner-magnet speaker of dual-magnetic gaps and dual-coil or a band-pass bass speaker is formed.

11. The multimedia sound system of claim 8, wherein:

the at least one multi magnetic gap is three magnetic gaps and the at least one multi coil is three coils each side of a circular plate made of magnetic material is mounted with a round sheet magnet and/or a NdFeB magnet that is used for magnetizing and that has a polarization in a thickness direction;

each of the magnets has a polarity on a side of the plate close to the magnet that is the same;

three circular plates made of magnetic material are mounted separately on a lateral face of each magnet to form a pair of repulsion magnets;

the three circular plates that are mounted on each magnet are mounted coaxially, have the same projected area and match a projected plane of the two coaxially mounted magnets;

in terms of axial height, a ring-shaped magnetic yoke that is mounted coaxially with a central axis of the circular plate that has each of its sides mounted with a round sheet magnet and/or a NdFeB magnet exceeds a lateral polar plane of each side of the circular plate that has each of its sides mounted with a round sheet magnet and/or a NdFeB magnet by 0.5 to 8 mm so as to form two groups of magnetic gap circuits that are characterized by a complete longitudinal symmetry;

an internal peripheral face of the ring-shaped magnetic yoke and a vertical peripheral face of the circular plate that has each of its sides mounted with a round sheet magnet and/or a NdFeB magnet constitute three coaxial ring-shaped magnetic gaps with equal diameter;

three coaxial coils of equal diameter that each have the same cross-sectional area are inserted into the ring-shaped magnetic gaps;

the coils are made by winding one or two layers of magnetic wires;

a winding direction of the coils and a direction of current flowing through the coils are prescribed so that the three coils generate an electromotive force in a direction at a working instant, if the central axis of the circular plate that has each its sides mounted with a round sheet magnet and/or a NdFeB magnet is chosen as a vertical symmetry axis and if a bisector at one-half axial height of the central plate is chosen as a horizontal axis of symmetry, the left channel speaker and/or the right channel speaker that has the three magnetic gaps and the three coils has a magnetic circuit that is marked by a bilateral and an up-down symmetry in terms of geometrical shape and magnetic property;

a coil resistance, a coil winding depth, an absolute value of an inductance of the coils, and a winding tension of each of the coils is equal; and while the bisector at the one-half axial height of the central plate is chosen as the horizontal axis of symmetry, the left channel speaker and/or the right channel speaker that has the three magnetic gaps and the three coils has two sets of coil circuits that have longitudinal symmetry so that a full frequency band inner-magnet speaker of three magnetic gaps and three coils or a band-pass bass speaker is formed.

12. The multimedia sound system of claim 11, wherein:

an axis position of the three plates of the inner-magnet speaker with three magnetic gaps and three coils, and an axis position of the two magnets are equipped with central axis holes of equal projected areas;

an axis position of one or more supports of the speaker is made from a non-magnetic material;

each of the one or more supports has a central axis hole of the same projected area or a matching screw hole;

a fastener made of non-magnetic material passes through the axis hole or the matching screw hole; and a pressure plate made of non-magnetic material that matches the plate exerts static pressure on the plate and the magnet so as to fasten them firmly at the one or more supports.

13. The multimedia sound system of claim 8, wherein:

the at least one multi magnetic gap is at least four magnetic gaps and the at least one multi coil is at least four coils;

each side of a circular plate of magnetic material is separately mounted with a round sheet magnet and/or a NdFeB magnet that is used for magnetizing and polarizing in a thickness direction;

each of the magnets has a polarity on a side of the plate close to the magnet that is the same;

at least four circular plates made of magnetic material are mounted separately on a lateral side of each magnet to form at least three pairs of repulsion magnets;

the at least four circular plates that are mounted on each magnet are mounted coaxially, have the same projected and match a projected plane of the at least three coaxially mounted magnets;

in terms of axial height, a ring-shaped magnetic yoke that is mounted coaxially with a central axis of the circular plate that has each of its sides mounted with a round sheet magnet and/or a NdFeB magnet exceeds a lateral polar plane of each side of the circular plate that has each of its sides mounted with a round sheet magnet and/or a NdFeB magnet by 0.5 to 8 mm so as to form two sets of magnetic gap circuits that are each characterized by a complete longitudinal symmetry;

an internal peripheral face of the ring-shaped magnetic yoke that is mounted coaxially with the repulsion magnets and a vertical peripheral face of the circular plate that has each of its sides mounted with a round sheet magnet and/or a NdFeB magnet constitute at least four coaxial ring-shaped magnetic gaps that each have the same equal diameter;

at least four coaxial coils having equal diameter and the same cross-sectional area are inserted into the ring-shaped magnetic gaps;

a winding direction of the coils and a direction of a current flowing through the coils are prescribed so that the coils generate electromotive force in a direction at a working instant;

if a central axis of the circular plate that has each of its sides mounted with a round sheet magnet and/or a NdFeB magnet is chosen as a vertical symmetry axis and if a bisector at one-half axial height of the central plate is chosen as a horizontal axis of symmetry, the left channel speaker and/or the right channel speaker that has the at least four magnetic gaps and the at least four coils has at least three magnetic circuits marked by a bilateral and an up-down symmetry in terms of geometrical shape and magnetic property;

when the left channel speaker and/or the right channel speaker that has the at least four magnetic gaps and the at least four coils is viewed in the lateral direction of the diaphragm, if at least half of the coils revolve in a clockwise direction, the remaining half of the coils revolve in an anticlockwise direction;

a tail end of a first coil of the at least four coils is connected in series with a head of a second coil of the at least four coils that is adjacent to the first coil of the at least four coils until all the coils of the at least four coils are connected series, wherein a tail end of a last coil of the at least four coils is connected in series with the head end of the first coil of the at least four coils to form a pair of signal input terminals of a transducer;

a cross-sectional area of each of the at least four coils is equal a winding number of each of the at least four coils is equal, a winding depth of each of the at least four coils is equal, an absolute value of a resistance of half of the at least four coils is equal to an absolute value of a resistance of the other half of the at least four coils, and an absolute value of an inductance of half of the at least four coils is to an absolute value of an inductance of the other half of the at least four coils;

a winding tension of each of the at least four coils is equal; and while a bisector at one-half axial height of the central magnet is chosen as a horizontal axis of symmetry, the left channel speaker and/or the right channel speaker that has the at least four magnetic gaps and the at least four coils has two sets of coil circuits that have longitudinal symmetry so that a full frequency band inner-magnet speaker of at least four magnetic gaps and at least four coils or a band-pass bass speaker is formed.

14. The multimedia sound system of claim 13, wherein:

an axis position of the at least four plates of the inner-magnet speaker with at least four magnetic gaps and at least four coils, and an axis position of the at least three magnets are equipped with central axis holes of equal projected areas;

an axis position of one or more supports of the speaker is made from a non-magnetic material;

each of the one or more supports has a central axis hole of the same projected area or a matching screw hole;

a fastener made of non-magnetic material passes through the axis hole or the matching screw hole; and a pressure plate made of non-magnetic material that matches the plate exerts static pressure on the plate and the magnet so as to fasten them firmly at the one or more supports.

15. A multimedia sound system with digital audio interfaces comprises:

a computer or game console having one or more interfaces comprising a Universal Serial Bus ("USB") interface, an Institute of Electrical and Electronics Engineers 1394 ("IEEE1394") interface, a coaxial cable interface, and a fiber-optic interface;

4 to 7 satellite speakers;

a subwoofer;

one or more 4.1 to 7.1 channel external sound cards connected, by the one or more interfaces, with one or more corresponding D type or T type IC chips of a 4.1 to 7.1 channel audio power amplifier of the satellite speakers and a 4.1 to 7.1 channel heavy bass audio amplifier of the subwoofer; and one or more control and protection circuits to protect the one or more 4.1 to 7.1 channel external sound cards, the audio power amplifier of the satellite speakers, the heavy bass audio amplifier of the subwoofer, the one or more IC chips, the satellite speakers, and/or the subwoofer, wherein:

the one or more 4.1 to 7.1 channel external sound cards, the one or more IC chips, one or more elements of a Surface Mount Device circuit ("SMD circuit") that is coupled to the one or more IC chips, one or more elements of an integrated Complementary Metal Oxide Semiconductor circuit ("CMOS circuit") that is integrated with the one or more IC chips, a LED signal light to indicate working conditions of the one or more external sound cards, a volume control device of the audio power amplifier of the satellite speakers, and/or a volume control of the heavy bass audio amplifier of the subwoofer are mounted on a PCB board;

the PCB, the LED signal light, and the volume control devices are mounted in the subwoofer or on a panel of the subwoofer where a socket matching the one or more interfaces is mounted;

the one or more interfaces are connected to the computer or the game console via a plug of an interface extension cable;

an audio jack is on one or more panels of one or more of the 4 to 7 satellite speakers;

each of the 4 to 7 satellite speakers is connected to the subwoofer via an audio cable to make a 4.1 to 7.1 channel sound system;

each of the one or more 4.1 to 7.1 channel external sound cards has one or more 4.1 to 7.1 channel DAC decoders of simplex 16 to 48 bits, one or more signals of the 4 to 7 satellite speakers are connected to the one or more IC chips of the audio power amplifier of the satellite speakers via the one or more DAC decoders, one or more analog signals of the subwoofer are connected to the heavy bass audio amplifier of the subwoofer via an electrical crossover with a band-pass width of 20 Hz to 250 Hz;

the one or more 4.1 to 7.1 channel external sound cards are powered by the one or more interfaces;

the audio power amplifier of the satellite speakers, the heavy bass audio amplifier of the subwoofer, and/or the one or more control and protection circuits are independently powered by an AC/DC power supply that is built into the subwoofer;

each of the one or more DAC decoders and each of the one or more IC chips of the audio power amplifier of the satellite speakers are connected in parallel to one or more filtering and energy storage electrolytic capacitors at locations closest to the input pins of the one or more DAC decoders and the one or more IC chips so that transient working voltages of the audio power amplifier of the satellite speakers and the one or more DAC decoders do not exceed a lower limit of a rated working voltage when the 4.1 to 7.1 channel sound system outputs a dynamic low audio signal of sufficiently large width;

the rated working voltage of the audio power amplifier is less than or equal to DC 5.25V or DC 8-15V;

a rated continuous output power of audio power amplifier of the satellite speakers is less than or equal to 1 W;

a rated continuous output power of the heavy bass audio amplifier of the subwoofer is less than or equal to 4 W or 8 W;

the one or more IC chips of the subwoofer are connected in parallel to one or more filtering and energy storage electrolytic capacitors that are less than or equal to 1,000 μF to 100,000 μF at locations closest to the power input pins of the one or more IC chips of the subwoofer;

one or more of the 4 to 7 satellite speakers has at least one multi magnetic gap and at least one multi coil that each have one or more resistor loads;

the one or more of the 4 to 7 satellite speakers that has the at least one multi magnetic gap and the at least one multi coil is equipped with a cone-shaped or concave diaphragm that has a caliber that is less than or equal to 7 inches;

the diaphragm of the one or more of the 4 to 7 satellite speakers that has the at least one multi magnetic gap and the at least one multi coil has a central hole with a diameter of 26 mm to 33 mm such that the one or more of the 4 to 7 satellite speakers that has the at least one multi magnetic gap and the at least one multi coil is a full frequency band speaker having 4 to 7 single-point coaxial sound production, wherein an inductance generated by the at least one multi magnetic gap and the at least one multi coil of the one or more of the 4 to 7 satellite speakers is offset by a phase angle of 180 degrees due to a counter electromotive force that results from a reciprocating motion;

the subwoofer has at least one multi magnetic gap and at least one multi coil that each have one or more resistor loads;

the subwoofer having the at least one multi magnetic gap and the at least one multi coil is equipped with a cone-shaped or concave diaphragm with a caliber that is less than or equal to 10 inches; and the diaphragm of the subwoofer having the at least one multi magnetic gap and the at least one multi coil has a central hole with a diameter of 26 mm to 33 mm such that the subwoofer that has the at least one multi magnetic gap and the at least one multi coil is a full frequency band speaker having one single-point coaxial sound production, wherein an inductance generated by the at least one multi magnetic gap and the at least one multi coil of the subwoofer is offset by a phase angle of 180 degrees due to a counter electromotive force that results from a reciprocating motion.

16. The multimedia sound system with digital audio interface of claim 15, wherein:

the elements and devices of the subwoofer of the system, except for a band pass filter of the subwoofer, that can be mounted in the subwoofer are segregated from the subwoofer and used to form an independent power amplifier;

the independent power amplifier comprises at least one indicating and regulating device, at least one audio input interface, and/or at least one audio output jack mounted on the independent power amplifier panel;

a panel of one or more of the 4 to 7 satellite speakers is mounted with a first audio jack;

a panel of the subwoofer is mounted with a second audio jack; and at least two audio cables are used to connect the independent power amplifier and the (4+1) to (7+1) speakers into the 4.1(+1) to 7.1(+1) channel digital multimedia sound system.

* * * * *